US011421366B2

(12) United States Patent
Im et al.

(10) Patent No.: US 11,421,366 B2
(45) Date of Patent: Aug. 23, 2022

(54) WASHING MACHINE AND CONTROL METHOD THEREOF

(71) Applicant: LG Electronics Inc., Seoul (KR)

(72) Inventors: Myunghun Im, Seoul (KR); Hwanjin Jung, Seoul (KR); Kyungchul Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 533 days.

(21) Appl. No.: 16/392,197

(22) Filed: Apr. 23, 2019

(65) Prior Publication Data

US 2019/0323161 A1 Oct. 24, 2019

(30) Foreign Application Priority Data

Apr. 24, 2018 (KR) ..... 10-2018-0047041

(51) Int. Cl.

| | |
|---|---|
| ***D06F 33/00*** | (2020.01) |
| ***D06F 33/46*** | (2020.01) |
| ***D06F 37/04*** | (2006.01) |
| ***D06F 37/26*** | (2006.01) |
| ***D06F 39/08*** | (2006.01) |

(Continued)

(52) U.S. Cl.

CPC ..... *D06F 33/46* (2020.02); *D06F 33/00* (2013.01); *D06F 37/04* (2013.01); *D06F 37/266* (2013.01); *D06F 39/085* (2013.01); *D06F 2101/10* (2020.02); *D06F 2101/14* (2020.02); *D06F 2101/20* (2020.02); *D06F 2103/04* (2020.02); *D06F 2103/18* (2020.02);

(Continued)

(58) Field of Classification Search

None

See application file for complete search history.

(56) References Cited

U.S. PATENT DOCUMENTS

2011/0083477 A1 4/2011 Kim et al.
2014/0033449 A1* 2/2014 Im ..... D06B 1/08 8/137

FOREIGN PATENT DOCUMENTS

EP 2698462 2/2014
EP 3214219 9/2017

(Continued)

OTHER PUBLICATIONS

PCT International Search Report for International Application No. PCT/KR2019/004948, dated Aug. 27, 2019, 4 pages.

(Continued)

*Primary Examiner* — Levon J Shahinian

(74) *Attorney, Agent, or Firm* — Fish & Richardson P.C.

(57) ABSTRACT

A method of controlling a washing machine includes: sensing a laundry amount accommodated in a drum; performing water supply into the drum according to the sensed laundry amount; rotating a pump motor at a certain initial rotation speed and transferring washing water discharged from the drum to at least one nozzle for spraying water into the drum; sensing a water level in the drum; performing a re-supply of water at least once until the sensed water level reaches a set water level; and increasing the rotation speed of the pump motor whenever the re-supply of water is performed, so that as the rotation speed of the pump motor is increased, the reaching range of the water stream sprayed through the nozzle gradually expands from the lower side of the circumferential surface of the drum to the rear surface of the drum.

20 Claims, 18 Drawing Sheets

(51) Int. Cl.

| | |
|---|---|
| *D06F 103/04* | (2020.01) |
| *D06F 103/18* | (2020.01) |
| *D06F 105/02* | (2020.01) |
| *D06F 105/06* | (2020.01) |
| *D06F 105/48* | (2020.01) |
| *D06F 101/10* | (2020.01) |
| *D06F 101/14* | (2020.01) |
| *D06F 101/20* | (2020.01) |

(52) U.S. Cl.
CPC ..... *D06F 2105/02* (2020.02); *D06F 2105/06* (2020.02); *D06F 2105/48* (2020.02)

(56) References Cited

FOREIGN PATENT DOCUMENTS

| | | |
|---|---|---|
| JP | 2009006081 | 1/2009 |
| JP | 2009297139 | 12/2009 |
| JP | 2013052127 | 3/2013 |
| KR | 1020040094202 | 11/2004 |
| KR | 20050012526 | 2/2005 |
| KR | 20080015295 | 2/2008 |
| KR | 101708665 | 2/2017 |
| KR | 1020170039995 | 4/2017 |
| WO | WO2011046363 | 4/2011 |
| WO | WO2014037840 | 3/2014 |
| WO | 2014131452 | 9/2014 |

OTHER PUBLICATIONS

Extended European Search Report in European Application No. 19170523.5, dated Oct. 21, 2019, 11 pages.
Office Action in Korean Appln. No. 10-2018-0047041, dated May 27, 2022, 16 pages (with English translation).

* cited by examiner

FIG. 8
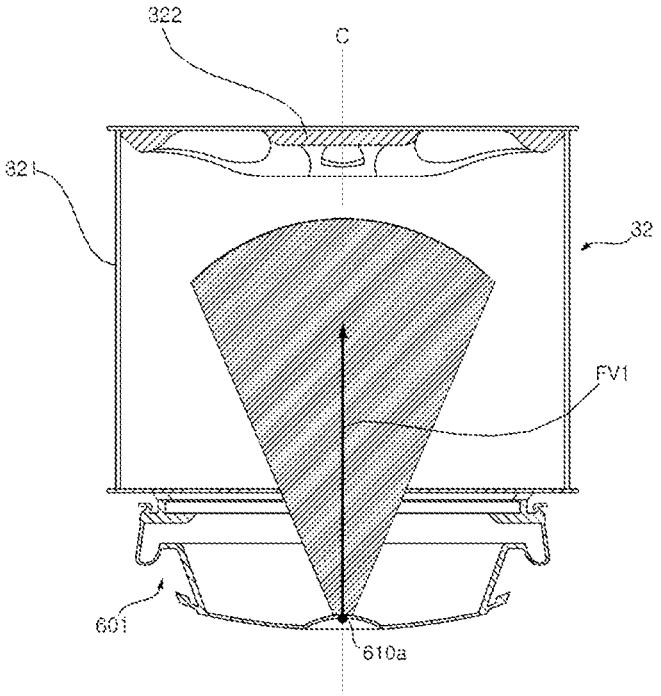
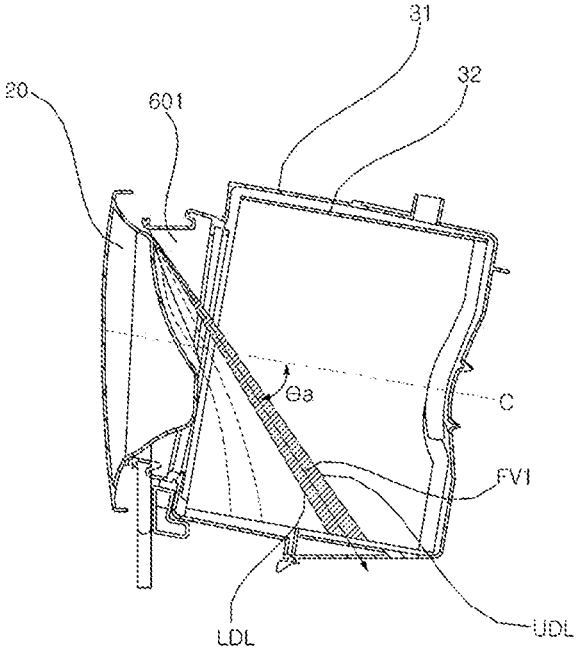
FIG. 9A
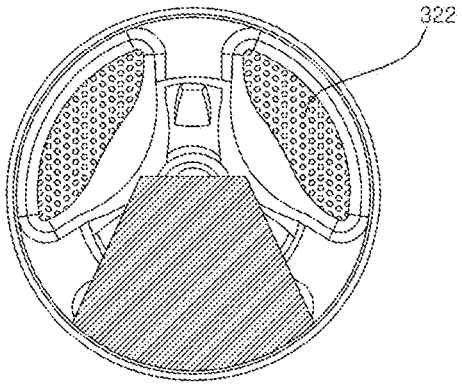
FIG. 9B

WASHING MACHINE AND CONTROL METHOD THEREOF

CROSS-REFERENCE TO RELATED APPLICATION

This application claims the priority benefit of Korean Patent Application No. 10-2018-0047041, filed on Apr. 24, 2018, the disclosure of which is incorporated herein by reference.

BACKGROUND OF THE INVENTION

1. Field of the Invention

The present invention relates to a control method of a washing machine having a circulation pump circulating wash water.

2. Description of the Related Art

Generally, a washing machine is an apparatus that separates contaminants from clothes, bedding, and the like (hereinafter, referred to as "laundry") by using chemical decomposition of water and detergent and physical action such as friction between water and laundry.

Such a washing machine includes a tub containing water and a drum rotatably provided in the tub to accommodate the laundry. Recent washing machines are configured to circulate water discharged from the tub by using a circulation pump, and to spray the circulated water into the drum through a nozzle.

In recent years, new technologies have been developed to control the rotation of the drum so as to impart variety to the flow of laundry introduced into the drum. Further, technologies for improving the washing effect by controlling the water pressure sprayed through the nozzle also have been developed.

SUMMARY OF THE INVENTION

The present invention has been made in view of the above problems, and provides a control method of a washing machine for performing a highly concentrated washing process in the early stage of washing and performing a strong spray washing process in the middle and late stages of washing.

The present invention further provides a control method of a washing machine which can actively perform water supply and circulation spraying in accordance with a quantity of a waste and a porosity.

In accordance with an aspect of the present invention, a method of controlling a washing machine includes: sensing a laundry amount accommodated in a drum; performing water supply into the drum according to the sensed laundry amount; rotating a pump motor at a certain initial rotation speed and transferring washing water discharged from the drum to at least one nozzle for spraying water into the drum; sensing a water level in the drum; performing a re-supply of water at least once until the sensed water level reaches a set water level; and increasing the rotation speed of the pump motor whenever the re-supply of water is performed.

As the rotation speed of the pump motor increases, a reach range of water stream sprayed through the at least one nozzle is gradually moved from a front surface of the drum toward a rear surface.

The method of controlling a washing machine further includes rotating the pump motor at a set maximum rotation speed, after the water level of the washing water reaches the set water level.

The maximum rotation speed is set to be higher as the sensed laundry amount becomes larger.

The rotation speed increase range of the pump motor due to the re-supply of water increases, as the sensed laundry amount becomes larger.

An initial rotation speed of the pump motor is set to be higher, as the sensed laundry amount becomes larger.

The set water level is set to be higher, as the sensed laundry amount becomes larger.

The water level in the drum is sensed in a state where a washing motor for rotating the drum is turned off.

The method of controlling a washing machine further includes performing additional water supply, when the water level in the drum is lowered below a certain water level after the re-supply of water is performed and the water level reaches the set water level.

The rotation of the pump motor is repeatedly performed intermittently.

The rotation speed of the pump motor is uniformly maintained while the re-supply of water is achieved.

In the water stream sprayed through the at least one nozzle, the water stream that is sprayed as the rotation speed of the pump motor increases reaches from a side surface portion of the drum to a rear surface portion thereof.

The washing machine includes: a tub disposed in a casing and having an opening formed on a front surface thereof; a pump having the pump motor; an annular gasket connecting the casing and the opening of the tub; and a nozzle water pipe fixed to the gasket for guiding water pumped by the pump to the at least one nozzle.

The nozzle water pipe includes: a circulation pipe connection port connected to the pump to supply the pumped water; and a transfer conduit connected to the circulation pipe connection port and guiding the water introduced through the circulation pipe connection port to the nozzle.

The transfer conduit is formed in an annular shape where a part of an upper end of a circumference is incised, and the water pumped to the circulation pipe connection port positioned at the lower end of the transfer conduit is branched and guided in both directions through the transfer conduit.

The transfer conduit is formed in an annular shape where a part of an upper end of a circumference is incised, and the at least one nozzle includes: a pair of intermediate nozzles, which is disposed above a center of the gasket, for spraying the water stream downward; and a pair of lower nozzles, which is disposed below the center of the gasket, for spraying the water stream upward.

The pair of intermediate nozzles and the pair of lower nozzles are connected to both left and right sides of the transfer conduit so that water introduced into the transfer conduit is sprayed into the drum through the pair of intermediate nozzles and the pair of lower nozzles.

The circulation pipe connection port is positioned at a lower end of the transfer conduit, and the water pumped to the circulation pipe connection port is branched and guided in both directions through the transfer conduit.

The washing machine includes: a tub disposed in a casing and having an opening formed on a front surface thereof; and an annular gasket connecting the casing and the opening of the tub.

The method of controlling a washing machine further includes spraying water supplied through a water supply valve into the drum through a direct water nozzle when the re-supply of water is performed.

BRIEF DESCRIPTION OF THE DRAWINGS

The above and other objects, features and other advantages of the present invention will be described in more detail below, taken in conjunction with the drawings, in which

FIG. 8 is a view showing a spray pattern of an upper nozzle taken along YZ(U) shown in FIG. 7B;

FIG. 9A is a view of a spray pattern of an upper nozzle taken along XY(R) shown in FIG. 7A, and FIG. 9B is a view taken along ZX(M) shown in FIG. 7A;

DETAILED DESCRIPTION OF THE PREFERRED EMBODIMENTS

Figure 1:
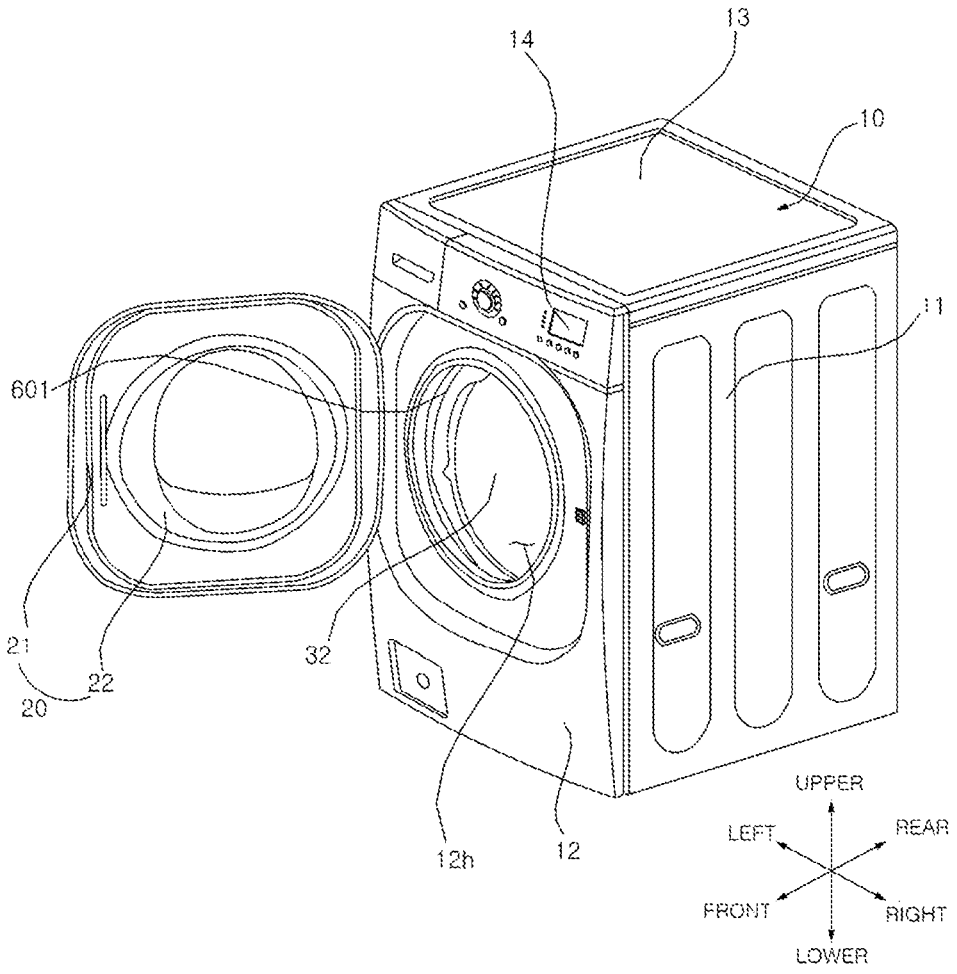
FIG. 1 is a perspective view illustrating a washing machine according to an embodiment of the present invention.

Advantages and features of the present invention and methods for achieving them will be made clear from the embodiments described below in detail with reference to the accompanying drawings. The present invention may, however, be embodied in many different forms and should not be construed as being limited to the embodiments set forth herein. Rather, these embodiments are provided so that this disclosure will be thorough and complete, and will fully convey the scope of the invention to those skilled in the art. The present invention is defined only by the scope of the claims. Like reference numerals refer to like elements throughout the specification.

Figure 2:
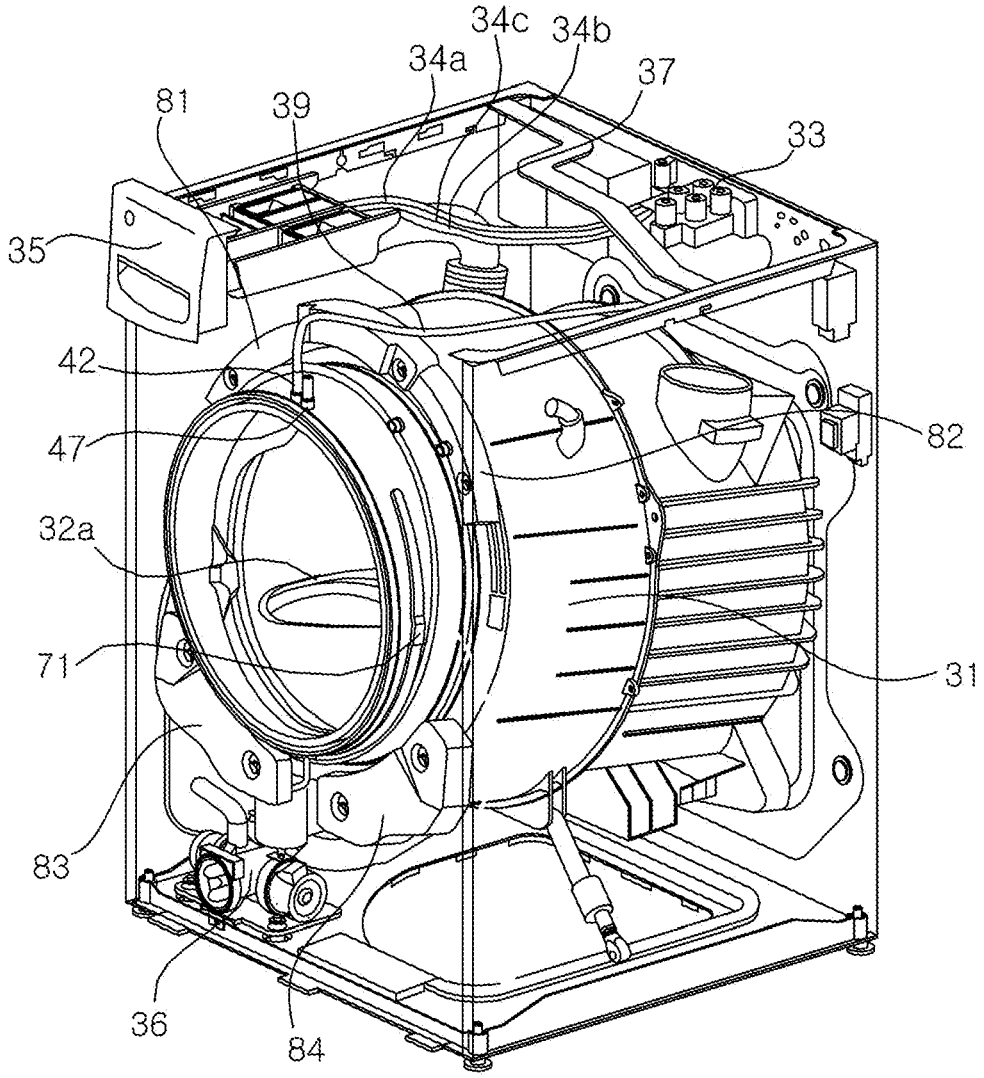
FIG. 2 shows a part of the washing machine shown in FIG. 1.
Figure 3:
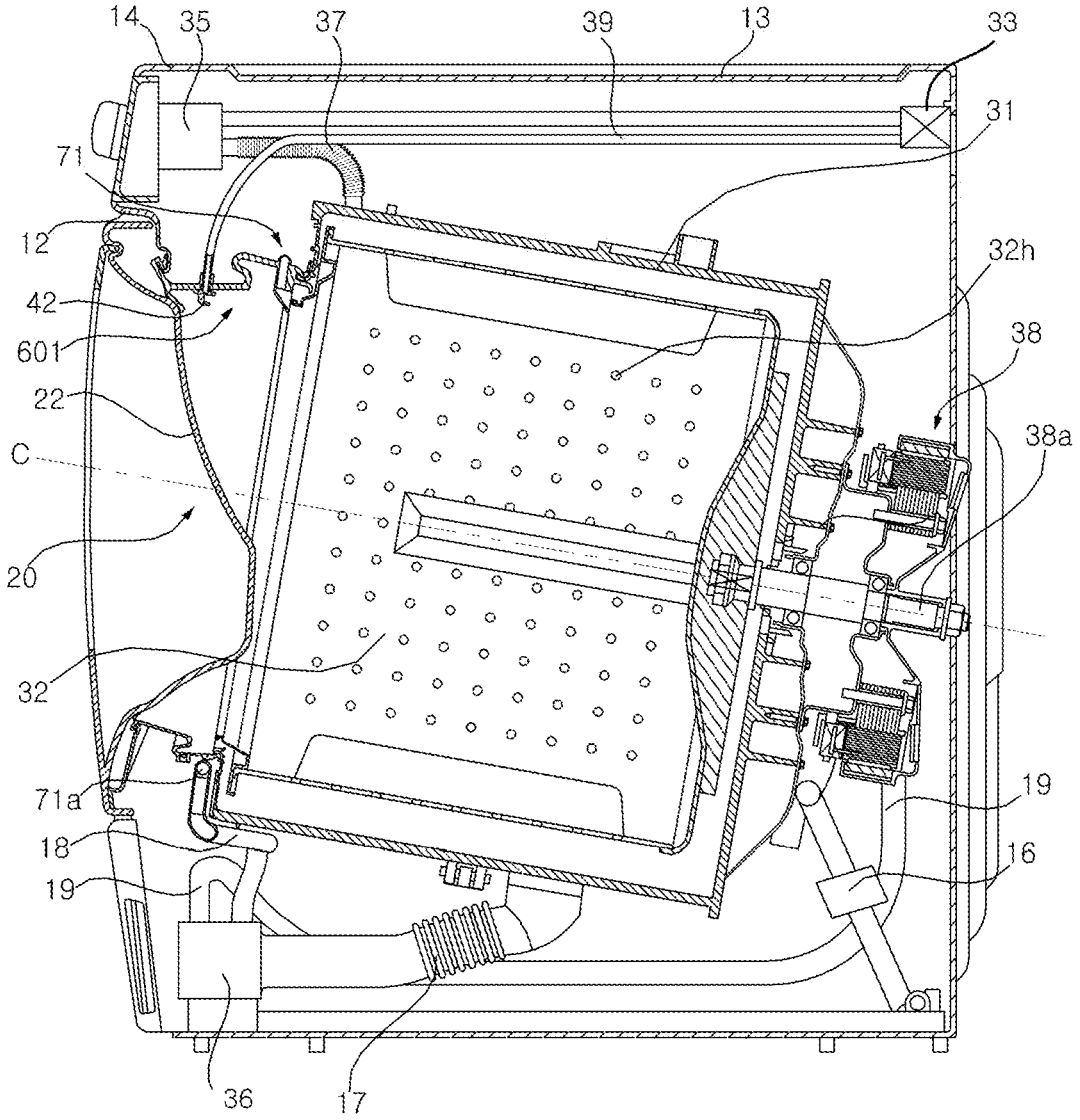
FIG. 3 is a side cross-sectional view of the washing machine shown in FIG. 2.

FIG. 1 is a perspective view illustrating a washing machine according to an embodiment of the present invention. FIG. 2 shows a part of the washing machine shown in FIG. 1. FIG. 3 is a side cross-sectional view of the washing machine shown in FIG. 2.

Referring to FIGS. 1 to 3, a casing 10 defines an outer shape of a washing machine, and a loading port 12*h* into which laundry is loaded is formed on the front surface. The casing 10 may include a cabinet 11 having a front surface that is opened, a left surface, a right surface, and a rear surface, and a front panel 12 coupled to the opened front surface of the cabinet 11 and having a loading port 12*h* formed therein. A bottom surface and an upper surface of the cabinet 11 are opened, and a horizontal base 15 supporting the washing machine may be coupled to the bottom surface. In addition, the casing 10 may further include a top plate 13 covering the open top surface of the cabinet 11 and a control panel 14 disposed in the upper side of the front panel 12.

In the casing 10, a tub 31 containing water may be disposed. The tub 31 has an opening formed on the front surface thereof so that laundry may be loaded. The cabinet 11 and the tub 31 may be connected by an annular gasket 601. The gasket 601 may form a passage ranging from the opening of the tub 31 to the loading port 12*h*.

A door 20 for opening and closing the loading port 12*h* may be rotatably coupled to the casing 10. The door 20 may include a door frame 21 which is open at a substantially central portion and is rotatably coupled to the front panel 12, and a transparent window 22 provided at the open central portion of the door frame 21. The window 22 has a backward convex shape so that at least a portion thereof may be positioned in an area surrounded by the inner circumferential surface of the gasket 601.

The gasket 601 serves to prevent water contained in the tub 31 from leaking. The gasket 601 has a front end portion and a rear end portion which are formed in an annular shape respectively, and has a cylindrical shape which is extend from the front end portion to the rear end portion. The front end portion of the gasket 601 is fixed to the casing 10, and the rear end portion is fixed around the opening of the tub 31. The gasket 601 may be made of a flexible or resilient material. The gasket 601 may be made of natural rubber or synthetic resin.

Hereinafter, the portion of the gasket 601 defining the inside of the cylindrical shape is referred to as the inner circumferential portion (or the inner circumferential surface) of the gasket 601, and the opposite portion is referred to as the outer circumferential portion (or the outer side surface) of the gasket 601.

In the tub 31, a drum 32 in which laundry is accommodated may be rotatably provided. The drum 32 is disposed such that an inlet through which the laundry is introduced is positioned on the front side, and is rotated around a substantially horizontal rotation center line C. However, the above mentioned "horizontal" is not a term used mathematically as a strict sense. That is, as in the embodiment, when the rotation center line C is inclined at a certain angle with respect to the horizontal, it also may be considered substantially horizontal because it is closer to horizontal than vertical. A plurality of through holes 32*h* may be formed in the drum 32 so that water in the tub 31 may be introduced into the drum 32.

A plurality of lifters 32*a* may be provided on the inner side surface of the drum 32. The plurality of lifters 32*a* may be disposed at a certain angle with respect to the center of the drum 32. When the drum 32 rotates, the laundry is lifted up by the lifter 32*a* and then dropped repeatedly.

A driving unit 38 for rotating the drum 32 may be further provided, and a driving shaft 38*a* rotated by the driving unit 38 may be coupled with the drum 32 through the rear surface portion of the tub 31.

Preferably, the driving unit 38 includes a direct-connection type washing motor. The washing motor may include a stator fixed to the rear of the tub 31, and a rotor rotated by magnetic force acting between the stator and the rotor. The driving shaft 38*a* may be rotated integrally with the rotor.

The tub 31 may be supported by a damper 16 provided in the base. The vibration of the tub 31 caused by the rotation of the drum 32 is attenuated by the damper 16. Although not shown, in some embodiments, a hanger (e.g., a spring) for hanging the tub 31 in the casing 10 may be further provided.

At least one water supply hose (not shown) for guiding water supplied from an external water source such as a faucet to the tub 31, and a water supply unit 33 for controlling the water supplied through the at least one water supply hose to be supplied to at least one water supply pipe 34*a*, 34*b*, 34*c* described later may be further provided.

A dispenser 35 for supplying an additive such as a detergent, a fabric softening agent or the like into the tub 31 or the drum 32 may be provided. In the dispenser 35, the additives may be separately accommodated according to their types. The dispenser 35 may include a detergent accommodating portion (not shown) for accommodating the detergent and a softening agent accommodating portion (not shown) for accommodating the fabric softening agent.

At least one water supply pipe 34*a*, 34*b*, 34*c* for selectively guiding the water supplied through the water supply unit 33 to the respective accommodating portions of the dispenser 35 may be provided. The water supply unit 33 may include at least one water supply valve 94 for interrupting at least one water supply pipe 34*a*, 34*b* and 34*c*, respectively.

The at least one water supply pipe 34*a*, 34*b*, 34*c* may include a first water supply pipe 34*a* for supplying cold water supplied through a cold water supply hose to the detergent accommodating portion, a second water supply pipe 34*b* for supplying cold water supplied through the cold water supply hose to the softening agent accommodating portion, and a third water supply pipe 34*c* for supplying hot water supplied through a hot water supply hose to the detergent accommodating portion.

The gasket 601 may be provided with a direct water nozzle 42 for spraying water into the drum 32, and a direct water supply pipe 39 for guiding the water supplied through the water supply unit 33 to the direct water nozzle 42. The direct water nozzle 42 may be a vortex nozzle or a spray nozzle, but is not necessarily limited thereto. The direct water nozzle 42 may be disposed on a vertical line passing through the center of the drum 32, when viewed from the front.

The water discharged from the dispenser 35 is supplied to the tub 31 through a water supply bellows 37. A water supply port (not shown) connected to the water supply bellows 37 may be formed on a side surface of the tub 31.

The tub 31 is formed with a drainage port for discharging water, and a drainage bellows 17 may be connected to the drainage port. A pump 36 for pumping water discharged from the tub 31 through the drainage bellows 17 may be provided. A drainage valve 96 for interrupting the drainage bellows 17 may be further provided.

The pump 36 may selectively perform the function of pumping the water discharged through the drainage bellows 17 to a drainage pipe 19, and to a circulation pipe 18 selectively. Hereinafter, the water which is pumped by the pump 36 and guided along the circulation pipe 18 is referred to as 'circulating water'.

The pump 36 may include a first pump motor 92 and a second pump motor 93. The first pump motor 92 may be a circulation pump motor that pumps the circulating water discharged from the tub 32 to a plurality of nozzles 610*b*, 610*c*, 610*d*, and 610*e*. The second pump motor 93 may be a drainage pump motor for draining water from the tub 32.

The pump 36 may vary the flow rate (or the discharge water pressure). To this end, the pump motors 92 and 93 may be a variable speed motor capable of controlling the rotation speed. Each of the pump motors 92 and 93 may be a Brushless Direct Current (BLDC) motor, but is not necessarily limited thereto. A driver for controlling the speed of the pump motor 92, 93 may be further provided, and the driver may be an inverter driver. The inverter driver converts AC power to DC power, and inputs to the motor at a target frequency.

A controller 91 for controlling the pump motors 92 and may be further provided. The controller may include a proportional-integral (PI) controller, a proportional-integral-derivative (PID) controller, and the like. The controller receives the output value (e.g., output current) of the pump motor as an input, and may control the output value of the driver so that the number of rotation of the pump motor follows a preset target number of rotation.

The controller 91 may control not only the rotation speed of the pump motors 92 and 93 but also the rotation direction. Particularly, since the induction motor used in the conventional pump cannot control the rotation direction at the time of starting, it is difficult to control the rotation of each impeller in a set direction, and there is a problem that the flow rate discharged from a discharge port varies depending on the rotation direction of the impeller. However, since the present invention can control the rotation direction of the pump motor 92, 93 at the time of starting, the conventional problem does not occur, and the flow rate discharged through the discharge port can be uniformly controlled.

Meanwhile, it is to be understood that the controller can control not only the pump motor 92, 93 but also the entire operation of the washing machine, and that the control of each part mentioned below is performed by the controller.

Referring to FIG. 2, at least one balancer 81, 82, 83, 84 may be provided on the front surface of the tub 31 along the opening of the tub 31. The balancer 81, 82, 83, and 84 is used to reduce the vibration of the tub 31, and is a weight body having a certain weight. A plurality of balancers 81, 82, 83, and 84 may be provided. A first upper balancer 81 and a second upper balancer 82 may be provided in the left and right sides of the upper part of the front surface of the tub 31, and a first lower balancer 83 and a second lower balancer 84 may be provided in the left and right sides of the lower part of the front surface of the tub 31.

Figure 4:
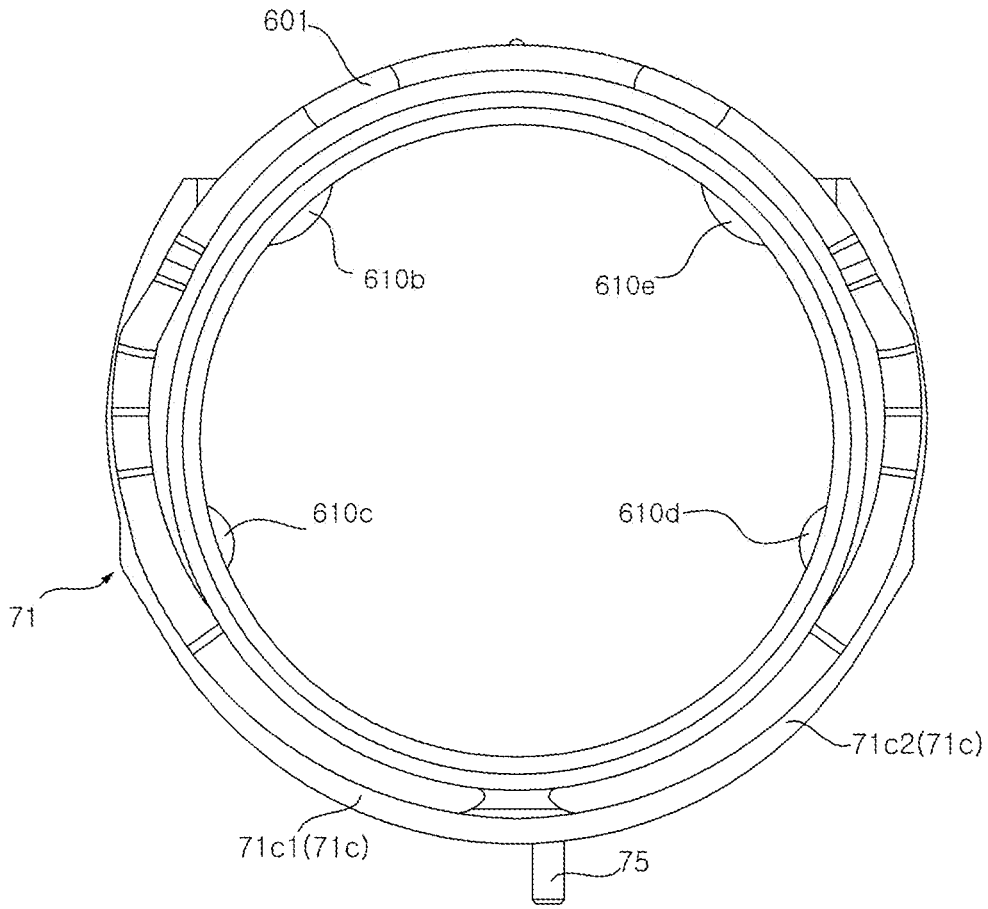
FIG. 4 shows an assembly of a gasket and a nozzle water pipe.
Figure 5:
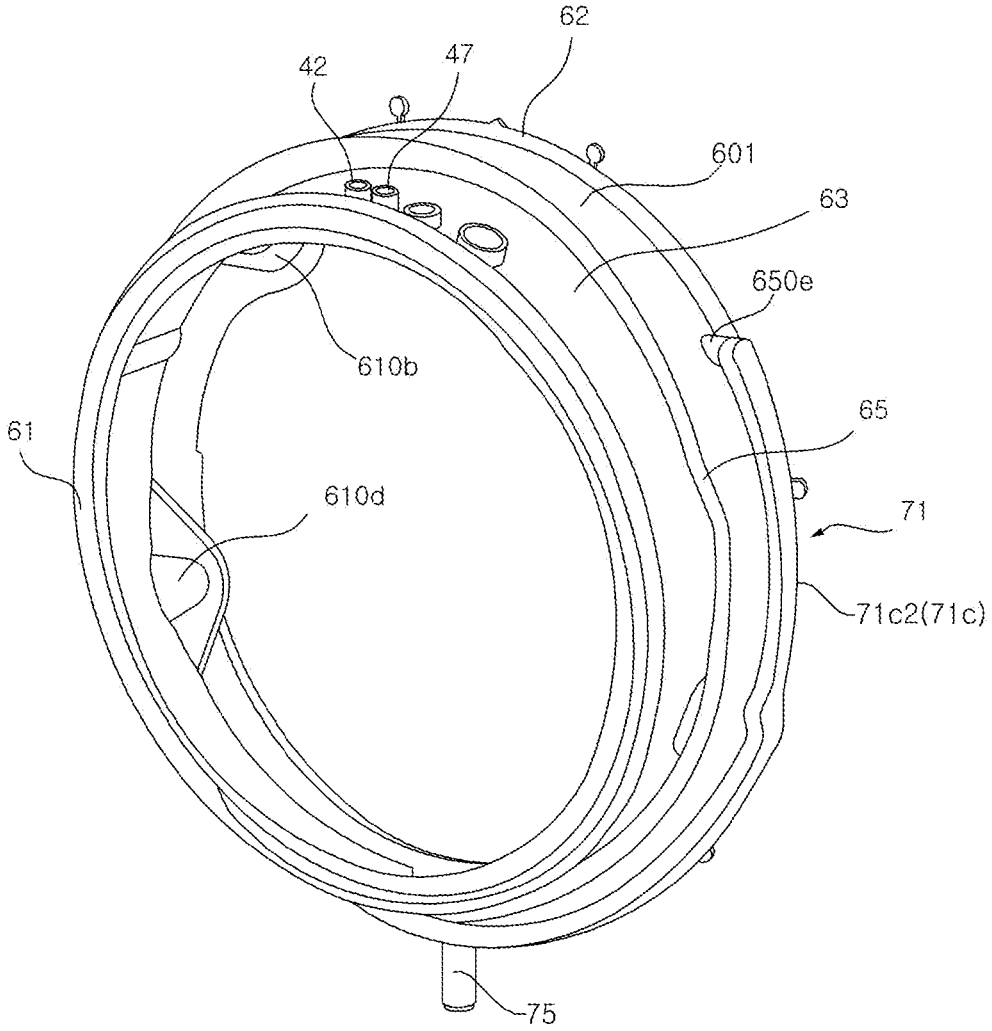
FIG. 5 is a view of the assembly shown in FIG. 4 from a different angle.

FIG. 4 shows an assembly of a gasket and a nozzle water pipe. FIG. 5 is a view of the assembly shown in FIG. 4 from a different angle. First, referring to FIG. 5, the gasket 601 may include a casing coupling part 61 coupled to the periphery of the loading port 12*h* of the casing 10, a tub coupling part 62 coupled to the periphery of the opening of the tub 31, and an extension part 63 extended between the casing coupling part 61 and the tub coupling part 62.

The casing coupling part 61 and the tub coupling part are formed in an annular shape respectively. the extension part 63 has an annular front end portion connected to the casing coupling part 61 and an annular rear end portion connected to the tub coupling part 62, and has a cylindrical shape extended from the front end portion to the rear end portion.

The front panel 12 is curled outward around the loading port 12*h* and the casing coupling part 61 may be fitted in the concave portion formed by the curled portion.

The casing coupling part 61 may be formed with an annular groove through which a wire is wound. After the wire is wound along the groove, both ends of the wire are bounded so that the casing coupling part 61 is firmly fixed to the periphery of the loading port 12*h*.

The tub 31 is curled outward around the opening, and the tub coupling part 62 may be fitted in the concave portion formed by the curled portion. The tub coupling part 62 may be formed with an annular groove through which a wire is wound. After the wire is wound along the groove, the both ends of the wire are bounded, so that the tub coupling part 62 is firmly coupled to the periphery of the opening of the tub 31.

Meanwhile, the casing coupling part 61 is fixed to the front panel 12, but the tub coupling part 62 is displaced according to the movement of the tub 31. Therefore, the extension part 63 should be able to be deformed in response to the displacement of the tub coupling part 62. In order to easily achieve such deformation, in the gasket 601, a folding part 65, which folded as it is moved in the direction (or radial direction) in which the tub 31 is moved due to eccentricity, may be formed in a section (or the extension part 63) between the casing coupling part 61 and the tub coupling part 62.

The drum 32 is vibrated (i.e., the rotation center line C of the drum 32 is moved) during the rotation process. Thus, the center line of the tub 31 (approximately, the same as the rotation center line C of the drum 32) is also moved, and at this time, the moving direction (hereinafter, referred to as "eccentric direction") has a radial component. The folding part 65 has a substantially Z-shaped cross section, and is folded or unfolded when the tub 31 is moved in the eccentric direction.

Referring to FIGS. 4 and 5, the gasket 601 includes a plurality of nozzles 610*b*, 610*c*, 610*d*, and 610*e* for spraying the circulating water into the drum 32. The plurality of nozzles 610*b*, 610*c*, 610*d*, and 610*e* may be formed in the inner circumferential portion of the gasket 601.

A nozzle water pipe 71 guides the circulating water pumped by the pump 36 to the plurality of nozzles 610*b*, 610*c*, 610*d* and 610*e* and is fixed to the gasket 601. The nozzle water pipe 71 may include a circulation pipe connection port 75 connected to a circulation pipe 18*a*, and a transfer conduit 71*c* for guiding the water introduced through the circulation pipe connection port 75.

The transfer conduit 71*c* may branch water introduced through the circulation pipe connection port 75 to both sides. The transfer conduit 71*c* may include a first conduit part 71*c*1 forming a first flow path in one side of the circulation pipe connection port 75, and a second conduit part 71*c*2 forming a second flow path in the other side. One end of the first conduit part 71*c*1 and one end of the second conduit part 71*c*2 are connected to each other, and the circulation pipe connection port 75 protrudes from such a connected part. However, the other end of the first conduit part 71*c*1 and the other end of the second conduit part 71*c*2 are separated from each other. That is, the transfer conduit 71*c* is formed in a Y-shape on the whole, and is configured to branch and guide the circulating water introduced through one inlet (i.e., the circulation pipe connection port 75) into two flow paths. At this time, the two flow paths are separated from each other.

In another aspect, the transfer conduit 71*c* is formed in an annular shape on the whole, but it may also be a shape in which a part of the circumference is cut. The portion cut on the circumference corresponds to the upper end of the first conduit part 71*c*1 and the upper end of the second conduit part 71*c*2.

The circulation pipe connection port 75 protrudes from the transfer conduit 71*c* and is connected to the circulation pipe 18. The circulation pipe connection port 75 may protrude outward along the radial direction from the transfer conduit 71*c*.

The plurality of nozzles 610*b*, 610*c*, 610*d* and 610*e* may include a pair of intermediate nozzles 610*b* and 610*e* which are disposed closer to the upper end of the gasket 601 than the lower end and spray the circulating water downward, and a pair of lower nozzles 610*c* and 610*d* which are disposed below the pair of intermediate nozzles 610*b* and 610*e* and spray the circulating water upward.

Meanwhile, the plurality of nozzles 610*b*, 610*c*, 610*d*, and 610*e* may further include an upper nozzle 610*a* (see FIG. 8) disposed above the pair of intermediate nozzles 610*b* and 610*e*. The upper nozzle 610*a* sprays water into the drum 32, and may spray water closer to the front surface of the drum 32 than the pair of intermediate nozzles 610*b* and 610*e*. In the embodiment, the direct water nozzle 42 corresponds to the upper nozzle 610*a*. However, a separate upper nozzle which is connected to the nozzle water pipe 71 and sprays the circulating water pumped by the pump 36 may be provided.

Hereinafter, the case where the upper nozzle is the direct water nozzle 42 (see FIG. 8) will be described as an example.

Referring to FIGS. 4 and 5, the pair of lower nozzles 610*c* and 610*d* may include a first lower nozzle 610*c* and a second lower nozzle 610*d* which are symmetrically disposed. The pair of intermediate nozzles 610*b* and 610*e* may include a first intermediate nozzle 610*b* and a second intermediate nozzle 610*e* which are symmetrically disposed.

The circulation pipe connection port 75 may be connected to the transfer conduit 71*c* from below any one of the plurality of nozzles 610*b*, 610*c*, 610*d*, and 610*e*. Preferably, the circulation pipe connection port 75 is connected to the lowermost point of the transfer conduit 71*c*.

That is, an inlet through which the water is introduced from the circulation pipe connection port 75 may be positioned at the lowermost point of the transfer conduit 71*c*. The pair of intermediate nozzles 610*b* and 610*e* may be formed above the inlet, and may be disposed in the left and right sides, respectively, based on the inlet. The pair of intermediate nozzles 610*b* and 610*e* are disposed symmetrically with respect to the left and right symmetry lines of the transfer conduit 71*c*. Accordingly, the spray directions of the respective intermediate nozzles 610*b* and 610*e* are also symmetrical with respect to the symmetry line.

The pair of intermediate nozzles 610*b* and 610*e* may be positioned at a middle height of the nozzle water pipe 71 or above the center C of the drum 32. Since the intermediate nozzles 610*b* and 610*e* spray the circulating water downward, when the drum 32 is viewed from the front, the circulating water passes through the area above the center C of the drum 32 at the inlet side of the drum 32, and is sprayed into the drum 32 in a downwardly inclined manner.

The pair of lower nozzles 610*c* and 610*d* are disposed above the inlet, but below the pair of intermediate nozzles 610*b* and 610*e*. The pair of lower nozzles 610*c* and 610*d* may be disposed in both the left and right sides based on the inlet, and are preferably disposed symmetrically with respect to a vertical line. Thus, the spray directions of the lower nozzles 610*c* and 610*d* are symmetric with respect to the vertical line.

The pair of lower nozzles 610*c* and 610*d* may be positioned at a middle height of the nozzle water pipe 71*c* or below the center C of the drum 32. Since the lower nozzles 610*c* and 610*d* spray the circulating water upward, when the drum 32 is viewed from the front, the circulating water passes through the area below the center C of the drum 32 at the inlet side of the drum 32, and is sprayed into the drum 32 in an upwardly inclined manner.

The upper nozzle 610*a* is preferably disposed on a bilateral symmetry line of the nozzle water pipe 71, and the shape of the circulating water sprayed through the upper nozzle 610*a* is symmetrical with respect to the symmetry line.

The controller may vary the spray pressure of the plurality of nozzles 610*b*, 610*c*, 610*d*, and 610*e* by controlling the speed of the first pump motor 92.

The gasket 601 may be formed symmetrically with respect to a certain straight line when viewed from the front, and the upper nozzle 610*a* may be positioned on the straight line. Since the first nozzles 610*b* and 610*c* are disposed symmetrically with the second nozzles 610*d* and 610*e* based on the straight line, when spray is performed simultaneously through the plurality of nozzles 610*b*, 610*c*, 610*d*, and 610*e* and the upper nozzle 610*a*, the overall shape of the water streams sprayed through these nozzles 610*a*, 610*b*, 610*c*, 610*d*, 610*e* is balanced with a bilateral symmetry when viewed from the front. Therefore, when these nozzles 610*a*, 610*b*, 610*c*, 610*d*, and 610*e* spray simultaneously, a star-shaped spray may be implemented.

Meanwhile, when spray is accomplished simultaneously by the plurality of nozzles 610*b*, 610*c*, 610*d*, and 610*e* for spraying the circulating water pumped by the pump 36 except for the upper nozzle 610*a* constituted by the direct-water nozzle, a butterfly-shaped spray can be implemented. In this case, the controller varies the rotation speed of the pump motor 92 to vary the spray pressure of the plurality of nozzles 610*b*, 610*c*, 610*d*, and 610*e*. Accordingly, the spray may be implemented with a shape in which butterfly wings flutter, and thus water can be uniformly sprayed into the drum 32.

The gasket 601 may be provided with a steam spray nozzle 47. The washing machine according to an embodiment of the present invention may include a steam generator (not shown) for generating steam. The steam spray nozzle 47 sprays steam generated by the steam generator into the drum 32.

Meanwhile, although not shown, the nozzle water pipe 71 may be formed in an annular shape other than the above-described "Y" shape. In this case, the upper nozzle 610*a* is configured to spray the circulating water that is pumped from the pump 36, so that the plurality of nozzles 610*a*, 610*b*, 610*c*, 610*d*, and 610*e* can simultaneously spray the circulating water.

Figure 6:
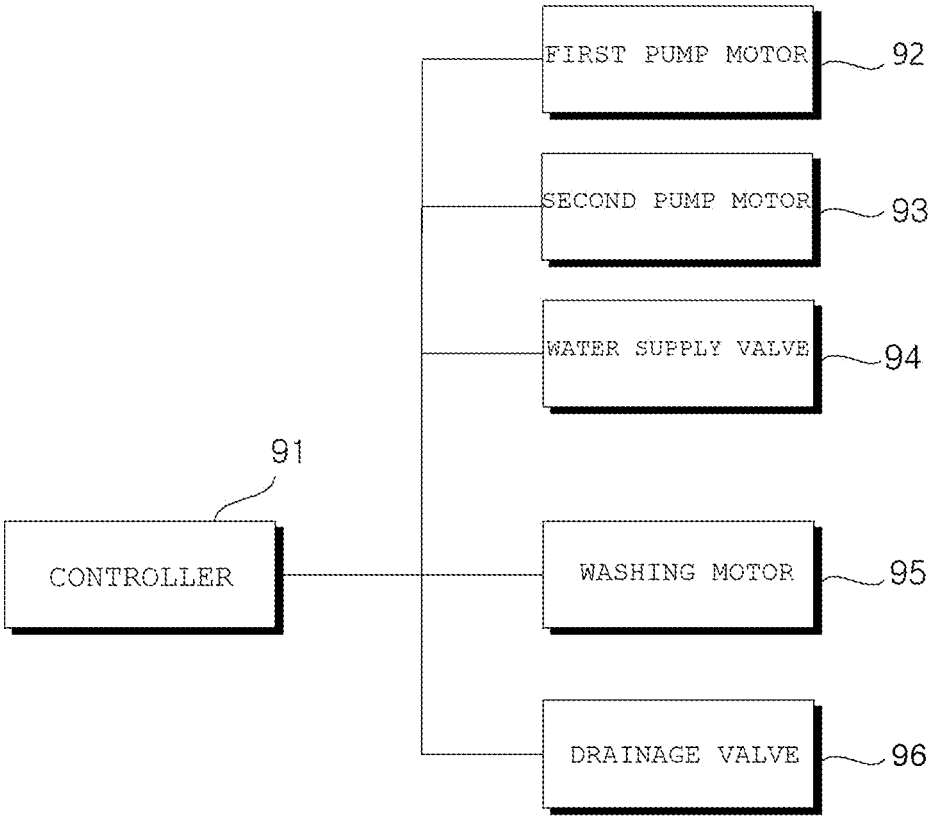
FIG. 6 is a block diagram showing a control relationship between the washing machine configurations according to an embodiment of the present invention.

FIG. 6 is a block diagram showing a control relationship between the washing machine configurations according to an embodiment of the present invention Referring to FIG. 6, when a user inputs settings (e.g., washing course, washing, rinsing, dehydrating time, dehydrating speed, etc.) through an input unit provided on the control panel 14, and controls the washing machine to operate according to the inputted settings. For example, a control algorithm for a water supply valve 94, a washing motor 95, a circulation pump motor 92, a drainage valve 96, and the like for each course that can be selected through the input unit may be stored in a memory (not shown), and the controller 91 may control the washing machine to operate according to an algorithm corresponding to the setting inputted through the input unit.

The controller 91 may control not only the circulation pump motor 92 but also the drainage pump motor 93, and furthermore, may control the overall operation of the washing machine. It can be understood that the control of each part is performed under the control of the controller 91 although not mentioned.

Figure 7A:
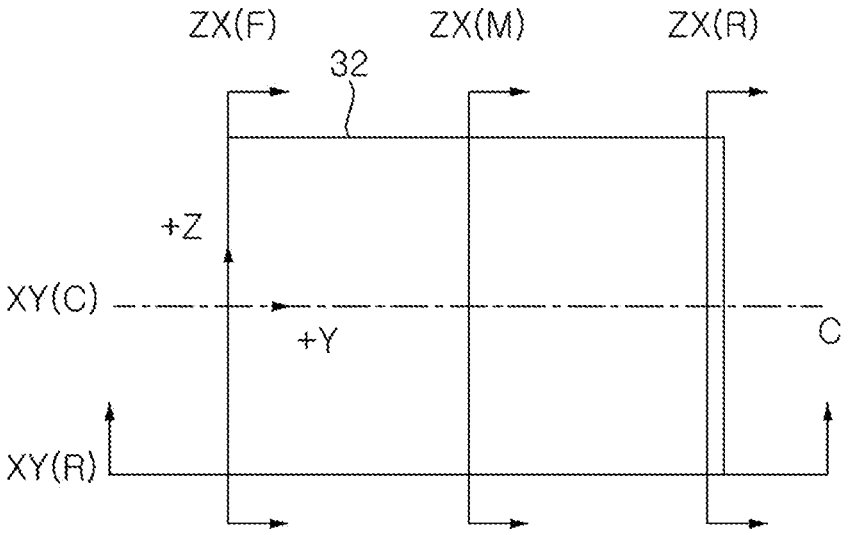
FIG. 7A schematically shows a drum viewed from the top downward, and FIG. 7B schematically shows a drum viewed from the front.
Figure 7B:
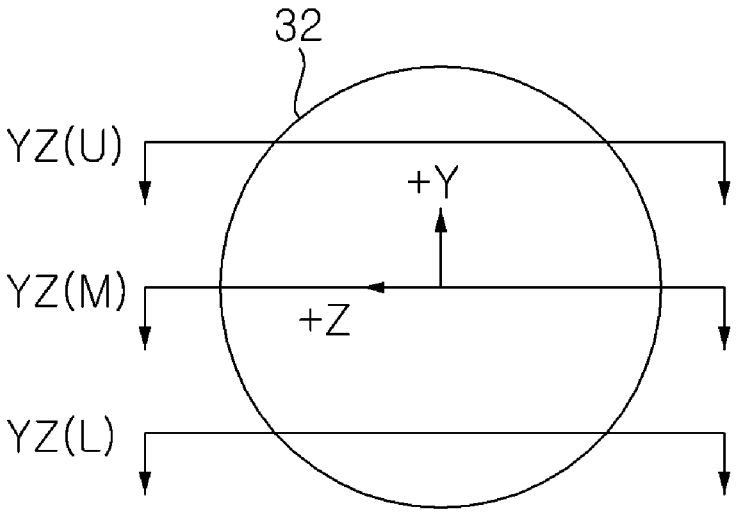

FIG. 7A schematically shows a drum viewed from the top downward, and FIG. 7B schematically shows a drum viewed from the front. Referring to FIGS. 7A and 7B, terms to be used below will be defined.

FIGS. 7A and 7B shows that the rear direction, the upper direction, and the left direction are indicated by +Y, +X, and +Z, respectively, based on the front view of the drum 32, ZX(F) indicates the ZX plane approximately at the front surface of the drum 32, ZX(M) indicates the ZX plane approximately at the middle depth of the drum 32, and ZX(R) indicates the ZX plane approximately in the vicinity of a rear surface portion 322 of the drum 32.

In addition, XY(R) represents the XY plane positioned at the right end of the drum 32, and XY(C) indicates the XY plane (or vertical plane) to which the center C of the drum 32 belongs.

In addition, YZ(M) indicates the YZ plane of approximately the middle height of the drum 32, YZ(U) indicates the YZ plane positioned above the YZ(M), and YZ(L) indicates the YZ plane positioned below the YZ(M).

FIG. 8 is a view showing a spray pattern of an upper nozzle taken along YZ(U) shown in FIG. 7B. FIG. 9A is a view of a spray pattern of an upper nozzle taken along XY(R) shown in FIG. 7A, and FIG. 9B is a view taken along ZX(M) shown in FIG. 7A.

Referring to FIGS. 8 to 9B, as shown in FIG. 9A, the water stream sprayed through the upper nozzle 610*a* is sprayed in the form of a water film having a certain thickness, and the thickness of the water film may be defined between an upper boundary (UDL) and a lower boundary (LDL). Hereinafter, the water stream shown in the drawings indicates the surface constituting the upper boundary UDL, and the surface constituting the lower boundary (LDL) is omitted.

The water stream shown by a dotted line in FIG. 9A indicates a case in which the water pressure becomes lower (i.e., a case in which the rotation speed of the pump motor is decreased) than that in the case where it is indicated by a solid line (in the case of the maximum water pressure). As the water pressure drops, the intensity of the water flow also weakens. Thus, it can be seen that the area that the water stream reaches is shifted to the inlet side of the drum 32.

In particular, the window 22 is protruded toward the drum 32 than the upper nozzle 610*a*. Accordingly, when the number of rotations of the pump motor becomes lower than a certain level, the water stream sprayed through the upper nozzle 610*a* may reach the window 22. In this case, there is an effect of cleaning the window 22.

The water stream sprayed through the upper nozzle 610*a* is symmetrical with respect to XY(C), and does not reach the rear surface portion 322 of the drum 32. As described above, since the spray direction of the upper nozzle 610*a* is determined according to the shape of the nozzle, even if the water pressure is continuously increased, the sprayed area cannot be deviated from a certain area. The water streams represented by the solid lines in FIGS. 8 to 13 show the states where the water streams are sprayed at the maximum intensity through the respective nozzles.

Referring again to FIGS. 8 to 9, the upper nozzle 610*a* may be configured to spray circulating water toward a side surface portion 321 of the drum 32. Specifically, the upper nozzle 610*a* sprays the circulating water downward toward the inside of the drum 32. At this time, the sprayed circulating water arrives at the side surface portion 321, but does not reach the rear surface portion 322. Preferably, the water stream sprayed through the upper nozzle 610*a* reaches the side surface portion 321 of the drum 32 in an area exceeding half the depth of the drum 32 (see FIG. 9A).

Meanwhile, in FIGS. 8 to 9B, the spray direction of the upper nozzle 610*a* is represented by a vector FV1. Specifically, the vector FV1 indicates the flow direction at the center of the water stream sprayed in the form of a water film, and is indicated based on the outlet of the upper nozzle 610*a*.

The vector FV1 is oriented as shown in FIG. 8, in the same direction as the rotation center line C when viewed from above, and as shown in FIGS. 9A and 9B, when viewed from the side, forms an angle θa with respect to the rotation center line C. The θa is approximately 35 to 45 degrees, preferably 40 degrees.

Figure 10:
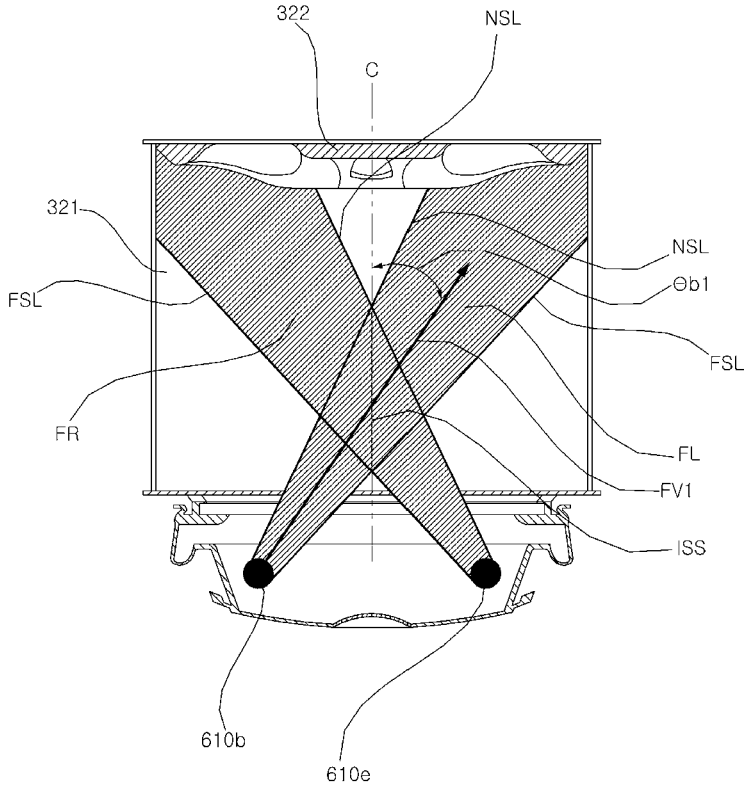
FIG. 10 is a view showing a spray pattern of intermediate nozzles taken along YZ(U) shown in FIG. 7B.
Figure 11A:
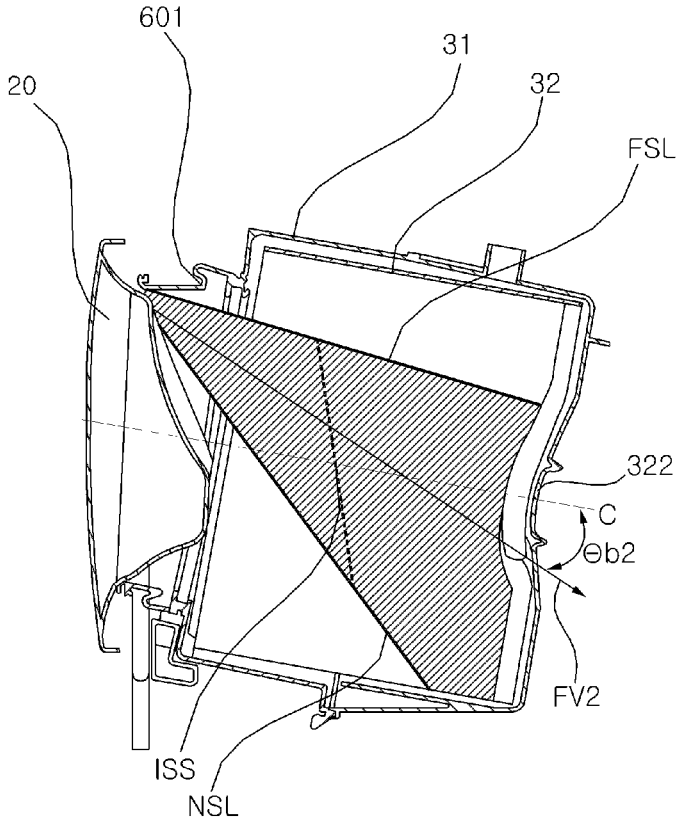
FIG. 11A is a view of a first intermediate nozzle taken along XY(R) shown in FIG. 7A.
Figure 11B:
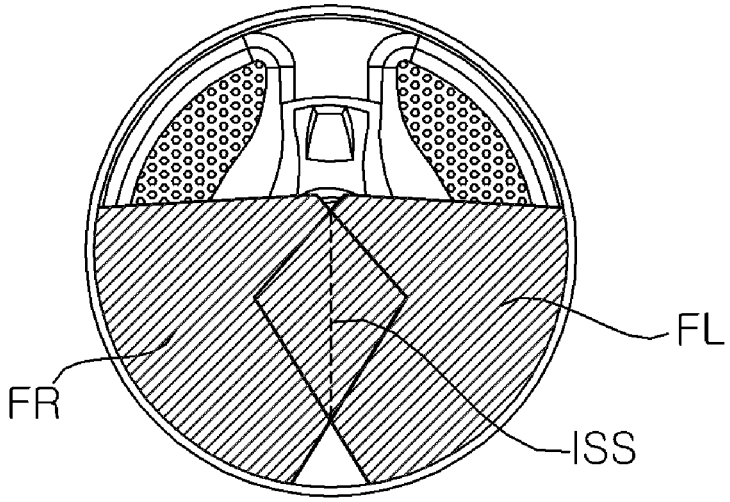
FIG. 11B is a view of a spray pattern of intermediate nozzles taken along ZX(F) shown in FIG. 7A.
Figure 11C:
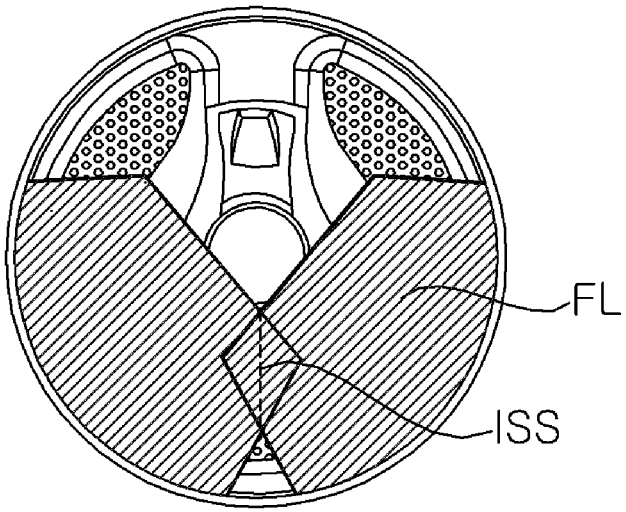
FIG. 11C is a view taken along ZX(M)

FIG. 10 is a view showing a spray pattern of intermediate nozzles taken along YZ(U) shown in FIG. 7B. FIG. 11A is a view of a first intermediate nozzle taken along XY(R) shown in FIG. 7A, FIG. 11B is a view of a spray pattern of intermediate nozzles taken along ZX(F) shown in FIG. 7A, FIG. 11C is a view taken along ZX(M), and FIG. 11D is a view taken along ZX(R).

Figure 11D:
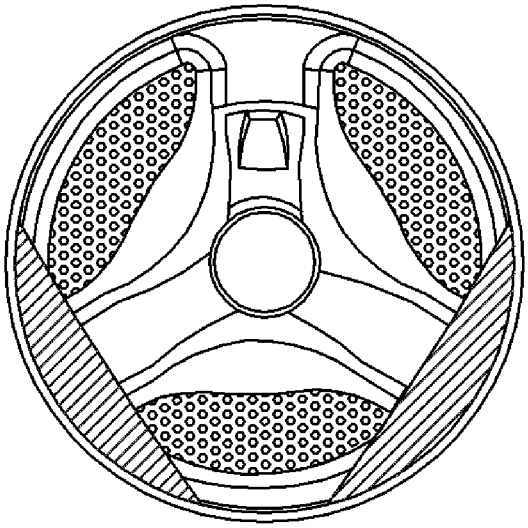
FIG. 11D is a view taken along ZX(R)

Referring to FIGS. 10 to 11D, the pair of intermediate nozzles 610*b* and 610*e* may include a first intermediate nozzle disposed in one side (or a first area) of the left and right sides based on the XY(C) plane and spraying the circulating water toward the other side (or a second area), and a second intermediate nozzle disposed in the other side based on the XY(C) plane and spraying the circulating water toward the one side.

The first intermediate nozzle 610*b* and the second intermediate nozzle 610*e* are disposed symmetrically with respect to the XY(C) plane, and the spray directions of the respective intermediate nozzles are also symmetrical to each other. The water stream sprayed through each intermediate nozzle has a width defined between one side boundary NSL adjacent to the side where the nozzle is disposed and the other side boundary FSL opposite to the one side boundary NSL.

The one side boundary NSL may be positioned below the other side FSL, and preferably, the one side boundary NSL meets the side surface portion 321 of the drum 32 while the other side boundary FSL meets the side surface portion 321 of the drum 32 at a higher position than the one side boundary NSL. That is, the water stream sprayed by the intermediate nozzle 610*b* and 610*e* constitutes a tilted water film which is downwardly directed to one side from the other side.

The water stream sprayed through each of the intermediate nozzles 610*b* and 610*e* reaches an area formed between a point where one side boundary NSL meets the side surface portion 321 of the drum 32 and a point where the other side boundary FSL meets the side surface portion 321 of the drum, and the area includes an area meeting the rear surface portion 322 of the drum 32. That is, a section where the water stream meets the drum 32 passes by the rear surface portion 322 of the drum 32 while proceeding downward toward the point where one side boundary NSL meets the side surface portion 321 of the drum 32 from the point where the other side boundary FSL meets the side surface portion 321 of the drum.

Hereinafter, it is illustrated that the first intermediate nozzle 610*b* is disposed in the left side (hereinafter, referred to as "left area") based on the XY(C) plane, and the second intermediate nozzle 610*e* is disposed in the right side (hereinafter, referred to as "right area") based on the XY(C) plane, and the spray pattern of the intermediate nozzles 610*b* and 610*e* will be described in more detail.

The first intermediate nozzle 610*b* sprays the circulating water toward the right area. That is, the water stream sprayed through the first intermediate nozzle 610*b* is not symmetrical with respect to the XY(C) plane but is deflected to the right side.

The left boundary NSL (one side boundary NSL) of the water stream FL sprayed through the first intermediate nozzle 610*b* is positioned below the right boundary FSL (or the other side boundary FSL), and meets the side surface portion 321 of the drum 32. The right boundary FSL (or the other side boundary FSL) of the water stream FL sprayed through the first intermediate nozzle 610*b* also meets the side surface portion 321 of the drum 32.

The right boundary FSL of the water stream FL sprayed through the first intermediate nozzle 610*b* meets the side surface portion 321 of the drum 32, preferably, in a position higher than the center C of the drum 32.

The section where the water stream FL sprayed through the first intermediate nozzle 610*b* meets the rear surface portion 322 of the drum 32 while proceeding downwardly to the left from the point where the right boundary FSL meets the side surface portion 321 of the drum 32, meets again the side surface portion 321 of the drum 32 and then reaches the point where the left boundary NSL meets the side surface portion 321 of the drum 32.

The second intermediate nozzle 610*e* sprays the circulating water toward the left area. That is, the water stream sprayed through the second intermediate nozzle 610*e* is not symmetrical with respect to the XY(C) plane but is deflected to the right.

The right boundary NSL (one side boundary NSL) of the water stream FL sprayed through the second intermediate nozzle 610*e* is positioned below the left boundary FSL (or the other side boundary FSL), and meets the side surface portion 321 of the drum 32. The left boundary FSL (or the other side boundary FSL) of the water stream FL sprayed through the second intermediate nozzle 610*e* also meets the side surface portion 321 of the drum 32.

The left boundary FSL of the water stream FL sprayed through the second intermediate nozzle 610*e* meets the side surface portion 321 of the drum 32, preferably, in a position higher than the center C of the drum 32.

The section where the water stream FL sprayed through the second intermediate nozzle 610*e* meets the drum 32 meets the rear surface portion 322 of the drum 32 while proceeding downwardly to the right from the point where the left boundary FSL meets the side surface portion 321 of the drum 32, meets again the side surface portion 321 of the drum 32 and then reaches the point where the right boundary NSL meets the side surface portion 321 of the drum 32.

In the drawing, a portion (hereinafter, referred to as "intersection section") where the water stream FL sprayed from the first intermediate nozzle 610*b* intersects with the water stream FR sprayed from the second intermediate nozzle 610*e* is indicated as ISS. The intersection section ISS starts from the front side than the middle depth of the drum and proceeds rearward and then is terminated before reaching the rear surface portion 322 of the drum 32. The intersection section ISS forms a line segment progressing downward from the front end to the rear end when viewed from the side (see FIG. 11A). The intersection section ISS is terminated, preferably, at a depth deeper than the intermediate depth of the drum 32 (see FIG. 11C).

Referring to FIG. 10 to FIG. 11D, the spraying direction of the intermediate nozzle 610*b*, 610*e* is indicated by a vector FV2. Specifically, the vector FV2 indicates the direction of flow at the center of the water stream sprayed in a water film form, based on the outlet of the intermediate nozzle 610*b*, 610*e*.

The vector FV2 forms an angle θb1 with respect to the rotation center line C when viewed from above as shown in FIG. 10, and forms an angle θb2 with respect to the rotation center line C when viewed from the side as shown in FIG. 39. The angle θb1 is approximately 5 to 15 degrees, preferably 10 degrees. and the angle θb2 is approximately 30 to 40 degrees, preferably 34 to 35 degrees.

Meanwhile, when the water stream sprayed from the pair of intermediate nozzles 610*b* and 610*e* is sprayed below a certain pressure, it may reach the inner surface of the window 22. The controller 91 may control the circulation pump motor 92 at a set speed so that the water stream sprayed from the pair of intermediate nozzles 610*b* and 610*e* reaches the inner side surface of the window 22, thereby cleaning the window 22.

Figure 12:
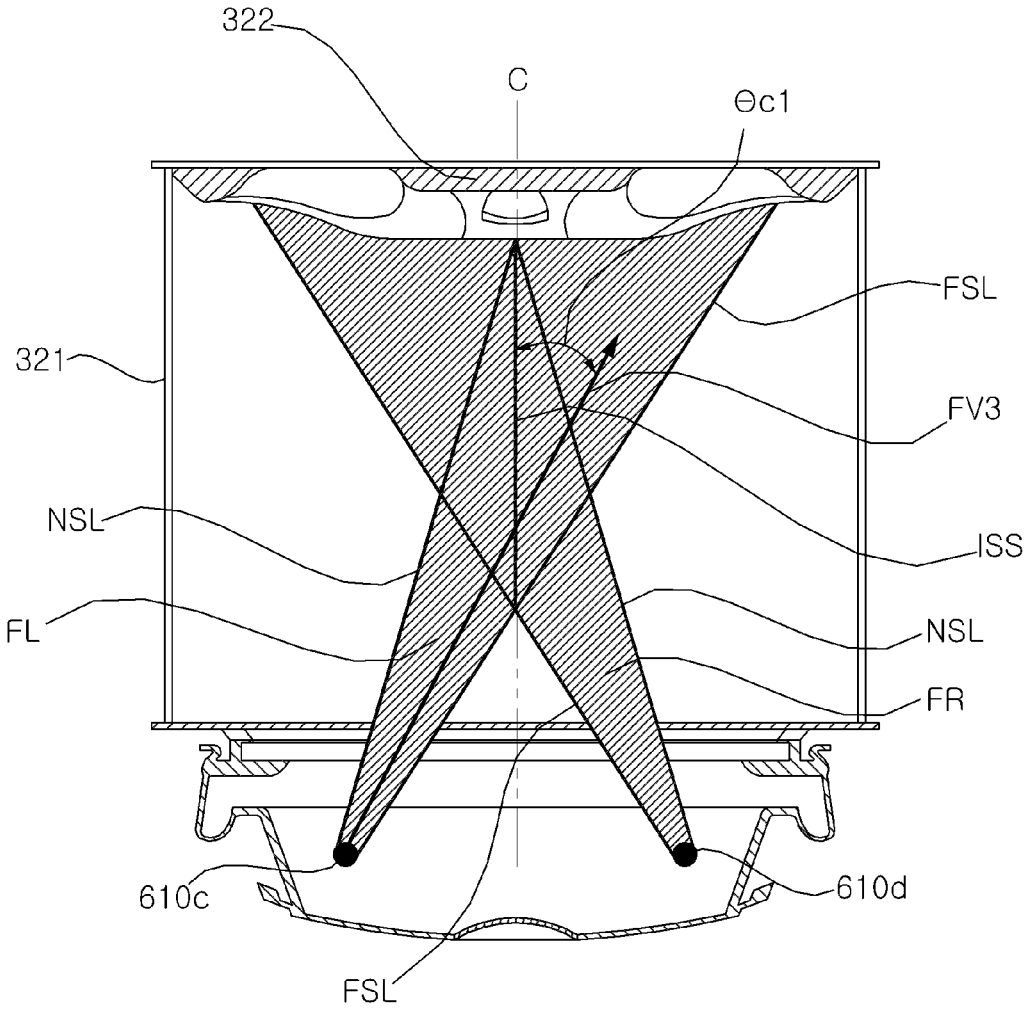
FIG. 12 is a view showing a spray pattern of lower nozzles taken along YZ(U) shown in FIG. 7B.
Figure 13A:
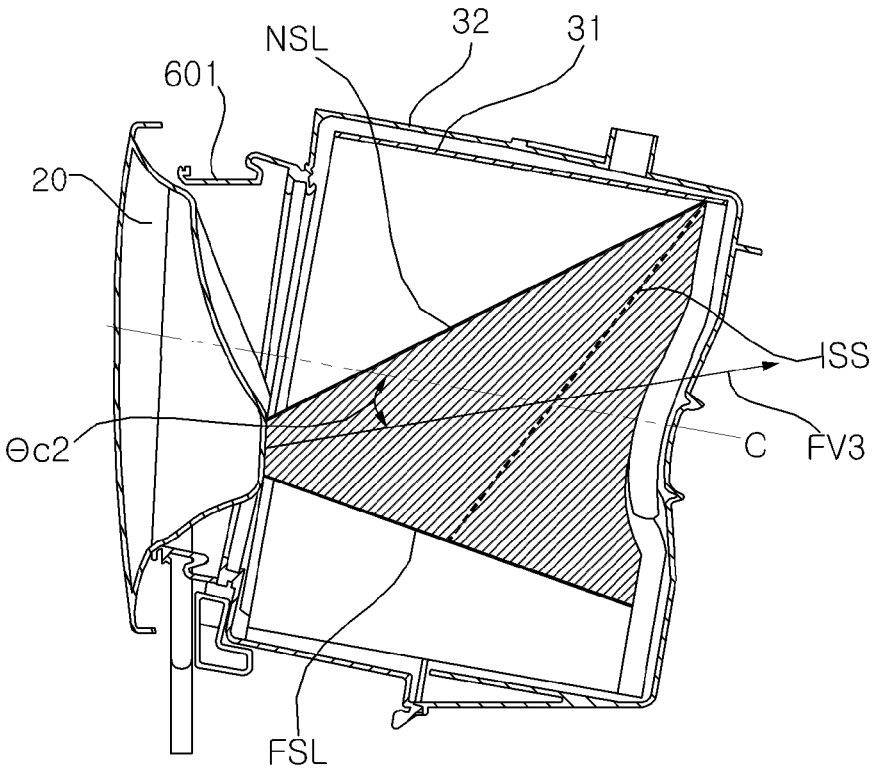
FIG. 13A is a view of a first lower nozzle taken along XY(R) shown in FIG. 7A.
Figure 13B:
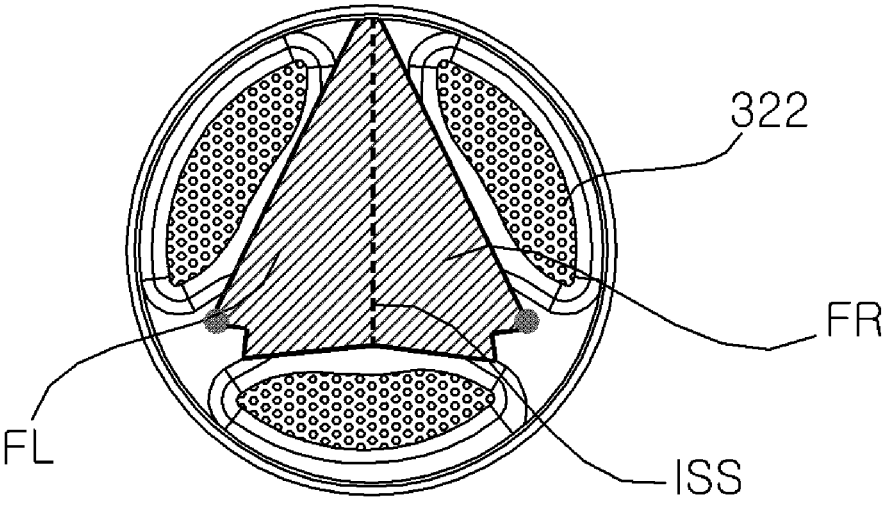
FIG. 13B is a view of a spray pattern of lower nozzles taken along ZX(F) shown in FIG. 7A.
Figure 13C:
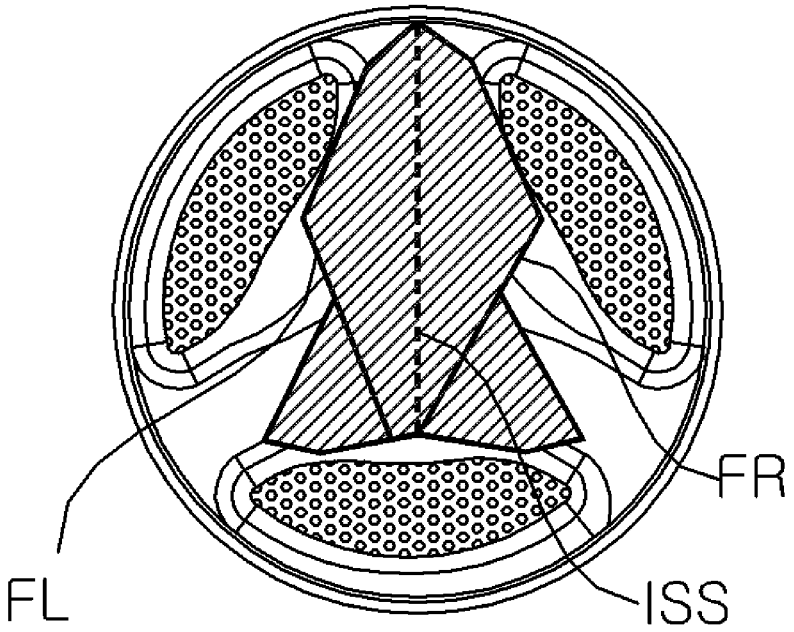
FIG. 13C is a view taken along ZX(M)

FIG. 12 is a view showing a spray pattern of lower nozzles taken along YZ(U) shown in FIG. 7B. FIG. 13A is a view of a first lower nozzle taken along XY(R) shown in FIG. 7A, FIG. 13B is a view of a spray pattern of lower nozzles taken along ZX(F) shown in FIG. 7A, FIG. 13C is a view taken along ZX(M), and FIG. 13D is a view taken along ZX(R).

Figure 13D:
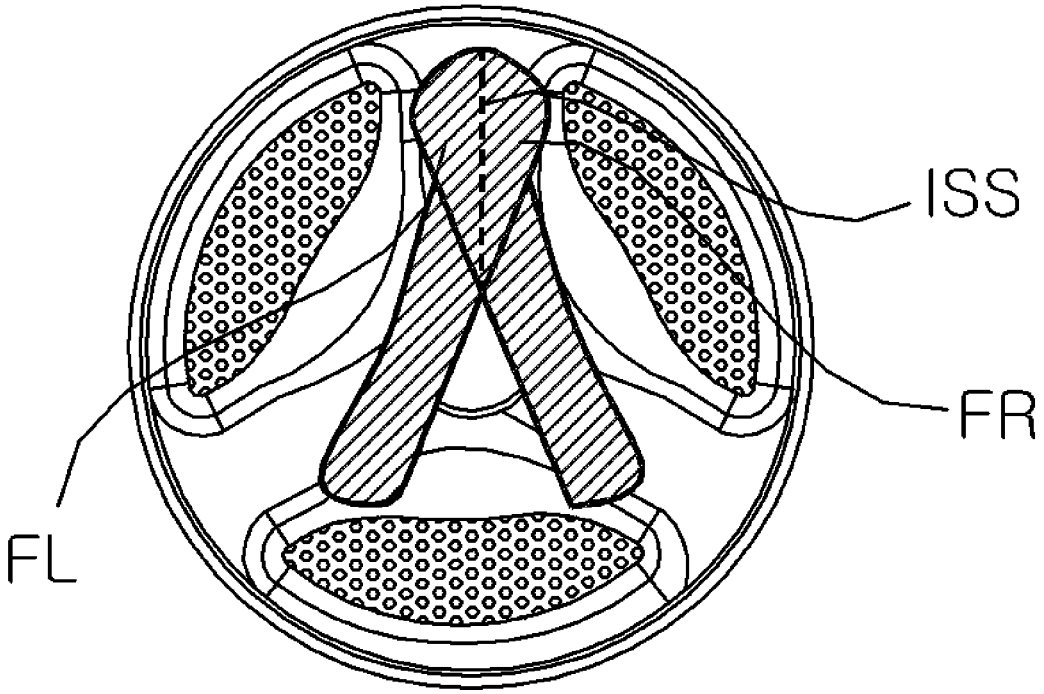
FIG. 13D is a view taken along ZX(R)

Referring to FIG. 12 to FIG. 13D, a pair of lower nozzles 610*c* and 610*d* may include a first lower nozzle 610*c* which is disposed in one side (or a first area) of the left and right sides based on the XY(C) plane and sprays the circulating water toward the other side (or a second area) and a second lower nozzle 610*d* which is disposed in the other side based on the XY(C) plane and sprays the circulating water toward the one side.

The first lower nozzle 610*c* and the second lower nozzle 610*d* are disposed symmetrically with respect to the XY(C) plane, and the spraying directions of the respective lower nozzles are also symmetrical to each other. The water stream sprayed through each lower nozzle has a width defined between one side boundary NSL near the nozzle side and the other side boundary FSL opposite to the one side boundary NSL.

The one side boundary NSL may be positioned above the other side boundary FSL. Preferably, one side boundary NSL meets the rear surface portion 322 of the drum 32, and the other side boundary FSL meets the rear surface portion 322 of the drum 32 in a position lower than one side boundary NSL. That is, the water stream sprayed by the lower nozzle 610*c*, 610*d* forms a tilted water film which is downwardly directed to the other side from one side.

The water stream sprayed through each of the lower nozzles 610*c* and 610*d* reaches an area formed between a point where one side boundary NSL meets the rear surface portion 322 of the drum 32 and a point where the other side boundary FSL meets the rear surface portion 322 of the drum.

Hereinafter, it is illustrated that the first lower nozzle 610*c* is disposed in the left side (hereinafter, referred to as "left area") based on the XY(C) plane, and the second lower nozzle 610*d* is disposed in the right side (hereinafter, referred to as "right area") based on the XY(C) plane, and the spray pattern of the lower nozzles 610*c* and 610*d* will be described in more detail.

The first lower nozzle 610*c* sprays the circulating water toward the right area. That is, the water stream sprayed through the first lower nozzle 610*c* is not symmetrical with respect to the XY(C) plane but is deflected to the right side.

The left boundary NSL (one side boundary NSL) of the water stream FL sprayed through the first lower nozzle 610*c* is positioned above the right boundary FSL (or the other side boundary FSL), and meets the rear surface portion 322 of the drum 32. The right boundary FSL (or the other side boundary FSL) of the water stream FL sprayed through the first lower nozzle 610*c* also meets the rear surface portion 322 of the drum 32.

The left boundary NSL of the water stream FL sprayed through the first lower nozzle 610*c* meets the rear surface portion 322 of the drum 32, preferably, in a position higher than the center C of the drum 32. The right boundary FSL of the water stream FL sprayed through the first lower nozzle 610*c* meets the rear surface portion 322 of the drum 32, preferably, in a position lower than the center C of the drum 32.

The section where the water stream FL sprayed through the first lower nozzle 610*c* reaches the point where the right boundary FSL meets the rear surface portion 322 of the drum 32 while proceeding downwardly to the right from the point where the left boundary NSL meets the rear surface portion 322 of the drum 32.

The second lower nozzle 610*d* sprays the circulating water toward the right area. That is, the water stream sprayed through the second lower nozzle 610*d* is not symmetrical with respect to the XY(C) plane but is deflected to the right.

The right boundary NSL (one side boundary NSL) of the water stream FL sprayed through the second lower nozzle 610*d* is positioned above the left boundary FSL (or the other side boundary FSL), and meets the rear surface portion 322 of the drum 32. The left boundary FSL (or the other side boundary FSL) of the water stream FL sprayed through the second lower nozzle 610*d* also meets the rear surface portion 322 of the drum 32.

The right boundary NSL of the water stream FL sprayed through the second lower nozzle 610*d* meets the rear surface portion 322 of the drum 32, preferably, in a position higher than the center C of the drum 32. The left boundary NSL of the water stream FL sprayed through the first lower nozzle 610*c* meets the rear surface portion 322 of the drum 32, preferably, in a position lower than the center C of the drum 32.

The section where the water stream FL sprayed through the second lower nozzle 610*d* meets the drum 32 reaches the point where the left boundary FSL meets the rear surface portion 322 of the drum 32, while proceeding downwardly to the left from the point where the left boundary NSL meets the rear surface portion 322 of the drum 32.

In the drawing, a portion (hereinafter, referred to as "intersection section") where the water stream FL sprayed from the first lower nozzle 610*c* intersects with the water stream FR sprayed from the second lower nozzle 610*d* is indicated as ISS. The intersection section (ISS) forms a line segment upward from the front end to the rear end when viewed from the side (see FIG. 13A). The intersection section ISS preferably is terminated at a depth deeper than the middle depth of the drum 32 (preferably, closer to the rear surface portion 322 than the middle depth of the drum 32) (see FIG. 13D).

Meanwhile, in FIG. 12 to FIG. 13D, the spraying direction of the lower nozzle 610*c*, 610*d* is indicated by a vector FV3. Specifically, the vector FV3 indicates the direction of flow at the center of the water stream sprayed in a water film form, based on the outlet of the intermediate nozzle 610*c*, 610*d*.

The vector FV3 forms an angle θc1 with respect to the rotation center line C when viewed from above as shown in FIG. 12, and forms an angle θc2 with respect to the rotation center line C when viewed from the side as shown in FIGS. 13A-13D. The angle θc1 is approximately 15 to 25 degrees, preferably 20 degrees. The angle θc2 is approximately 20 to 30 degrees, preferably 25 to 26 degrees.

Figure 14A:
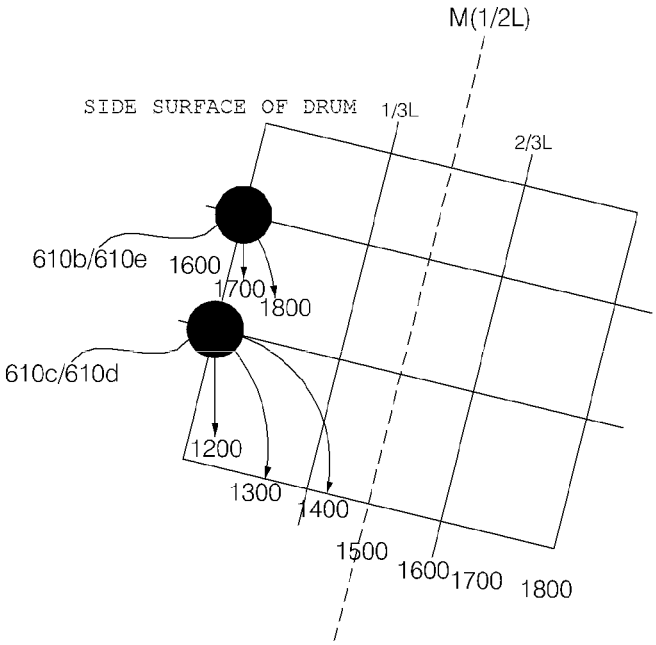
FIGS. 14A to 14C are views for explaining a spray range of a nozzle according to a rotation speed of a circulation pump motor according to an embodiment of the present invention.
Figure 14B:
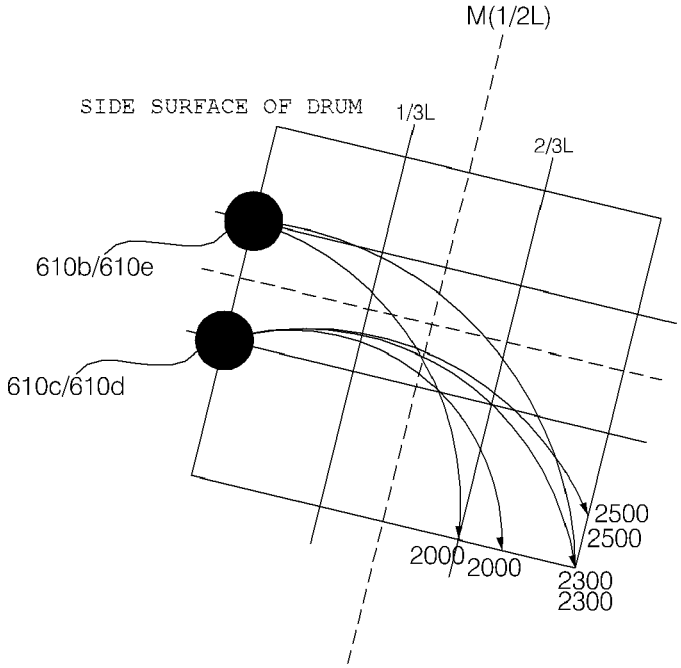
Figure 14C:
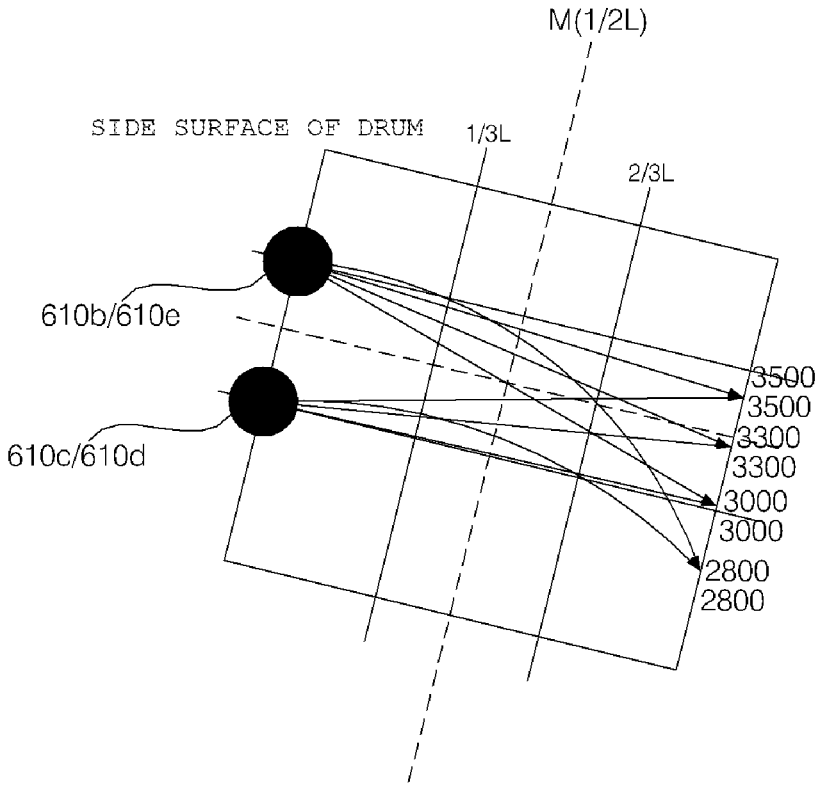

FIGS. 14A to 14C are views for explaining a spray range of a nozzle according to a rotation speed of a circulation pump motor according to an embodiment of the present invention.

FIGS. 14A to 14C show the spray range of the water stream sprayed from the intermediate nozzle 610*b*, 610*e* and the lower nozzle 610*c*, 610*d* that spray water into the drum 32 as the circulation pump motor 92 rotates.

When a first area, a second area, and a third area are defined sequentially from the front by trisecting the drum viewed from the side, as the rotation speed of the circulation pump motor 92 gradually increases, it can be seen that the water stream sprayed from the nozzle 610*b*, 610*c*, 610*d*, 610*e* reaches the deeper position of the drum 32.

For example, referring to FIGS. 14A and 14B, when the rotation speed of the circulation pump motor 92 is 1300 rpm, the water stream sprayed from the nozzle 610*b*, 610*c*, 610*d*, 610*e* reaches the first area of the side surface portion 321 of the drum 32. In the case of 2000 rpm, the water stream sprayed from the intermediate nozzle 610*b*, 610*e* reaches the second area, and the water stream sprayed from the lower nozzle 610*c*, 610*d* reaches the second area. In the case of 2300 rpm, the water stream sprayed from the nozzle 610*b*, 610*c*, 610*d*, 610*e* reaches the third area.

Referring to FIG. 14C, when the rotation speed of the circulation pump motor 92 is further increased, the water stream reaches the rear surface portion 322 of the drum 32. At 3000 rpm, the water stream reaches ⅓ of the height H of the drum 32. At 3500 rpm, the water stream reaches ⅔ of the height H of the drum 32. When the rotation speed of the circulation pump motor 92 reaches 3500 rpm, the height of the water stream becomes the maximum and, structurally, the spraying height of the nozzle 610*b*, 610*c*, 610*d*, 610*e* cannot be increased any more, but only the intensity of the water stream can be strengthened.

Figure 15:
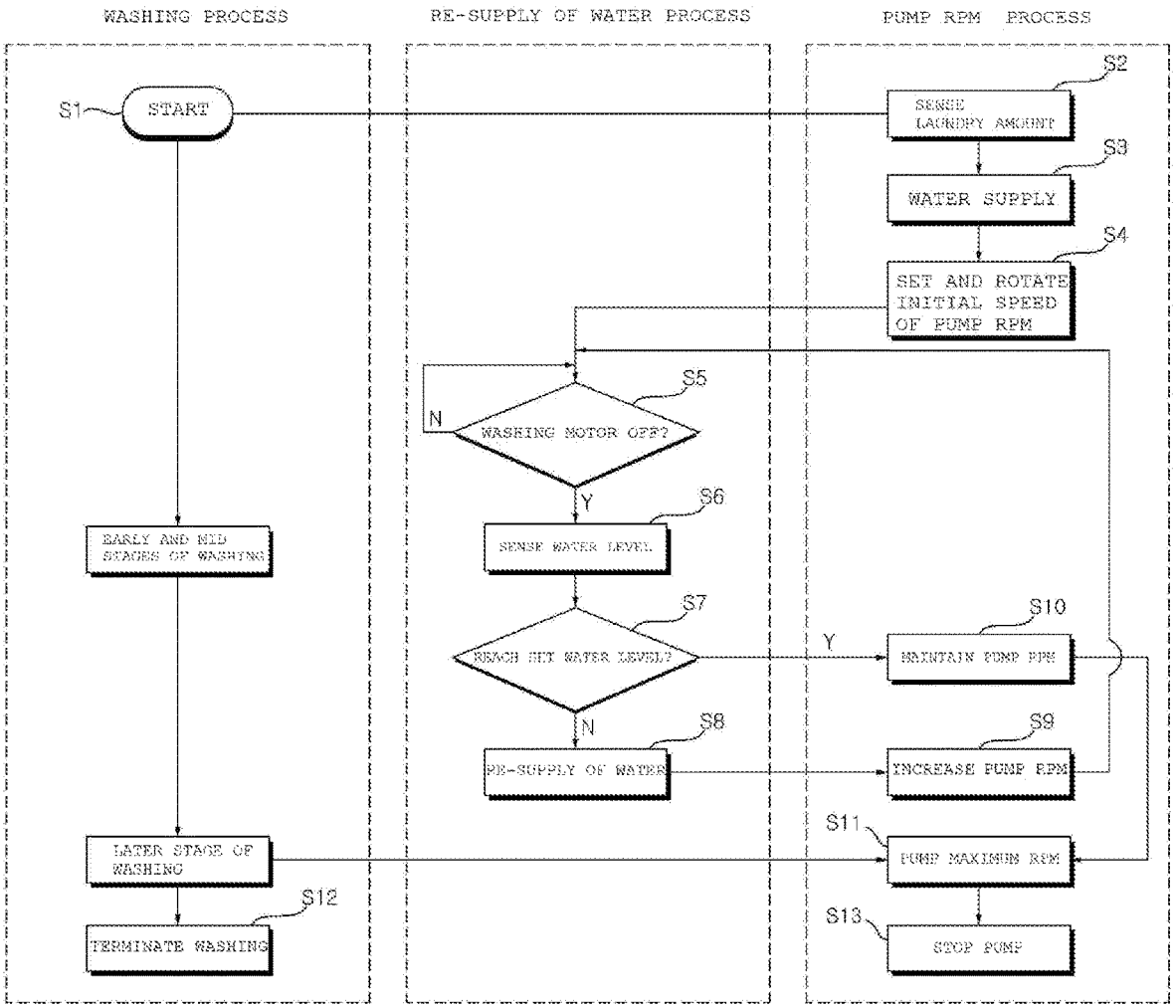
FIG. 15 is a flowchart showing a change of the pump RPM due to re-supply of water.

Meanwhile, the rotation speed value Rpm of the circulation pump motor 92 in FIG. 15 is a value according to an embodiment of the present invention, which may vary depending on the size and shape of the water supply pipe, and the specification of the pump. However, as the rotation speed of the circulation pump motor 92 is increased as shown in FIGS. 14A to 14C, the tendency of the water stream reaching the upper side of the rear surface portion 322 from the front of the drum 32 may be the same.

Figure 16:
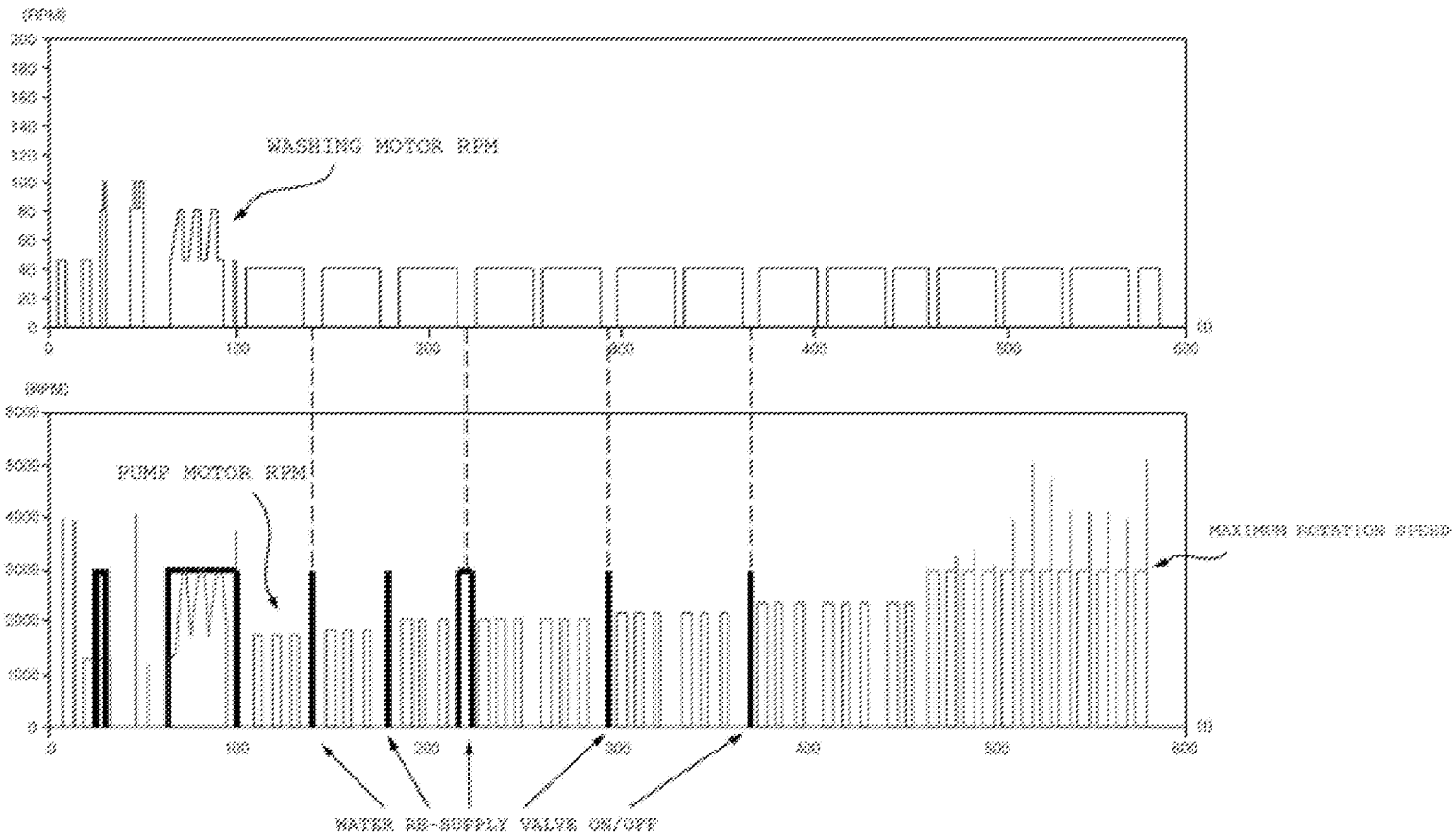
FIG. 16 is a graph showing the relationship between the driving of washing motor, the pump motor RPM, and the point of re-supply of water.

FIG. 15 is a flowchart showing a change of the pump RPM due to re-supply of water. FIG. 16 is a graph showing the relationship between the driving of washing motor, the pump motor RPM, and the point of re-supply of water.

Hereinafter, the water supply process during the early stage, mid and later stages of washing, and the overall operation direction and effect of the pump motor will be described.

When the laundry is introduced through the drum, a process of dissolving detergent through the water supply is first performed, and then a laundry wetting process for wetting the laundry with the washing water is performed. In this case, when the amount of water supplied in the early stage of washing is utilized for the laundry wetting, the amount of the circulatable residual water is very small and is slowly filled.

In the early stage of washing, as the amount of washing water becomes smaller, the washing performance is enhanced. This is because that a higher concentration of detergent water is formed as the amount of supplied water becomes smaller based on a constant amount of detergent.

Therefore, in order to improve the washing performance, it is preferable that the water supply is performed in such a manner that the minimum amount of residual water that may be circulated by the pump 36 is added to the minimum amount of laundry wetting water that can completely wet the laundry.

Such a high-concentration washing has an advantage, even in the heating process, in that as the amount of washing water becomes smaller, the temperature of the washing water can be raised faster, and the amount of power consumed for heating can be reduced. However, in this case, the minimum level at which the heater can be completely sunk must be maintained to prevent breakage and safety accidents due to overheating of the heater.

The early stage of the washing cycle is a preparation process for the main washing, and a high-concentration washing process is suitable for this stage. However, when the main washing is started, more powerful spraying and circulating of washing water is required. This is because the purpose of the main washing process is to clean the laundry by removing contaminants attached to the laundry. Therefore, preferably, a small amount of residual water (the water that is not absorbed by the laundry and remained in the tub) is maintained in the early stage of the washing process, and then a larger amount of washing water is circulated through the re-supply of water while progressing to the later stage of the washing process, and at the same time, the pump RPM is increased to strengthen the mechanical force, so that the intensive spray washing is performed. In order to perform the intensive spray washing, it is important to appropriately control the increase of the washing water through the re-supply of water and the increase of the pump RPM. In this respect, the present invention proposes a method for automatically controlling the re-supply of water, the number of times of the re-supply of water, and the increase of pump RPM due to the re-supply of water.

According to such a control method, the intensity of the water sprayed through the circulation nozzle is adjusted in response to the change in the water level in the drum, the water level in the drum is maintained at a low level in the early stage of washing process and the washing is performed with the high concentration washing water. Then, in the later stage of the washing, the washing effect can be improved by performing washing by gradually raising a water level In addition, when the rotation speed of the pump motor is uniformly maintained at a high speed, the water level in the drum is lowered and re-supply of water is required. In this case, the amount of water used for washing may increase and the concentration of the detergent water may also be lowered. According to the embodiment of the present invention, by changing the rotation speed of the pump motor according to the water level in the drum, the amount of water used for washing can be reduced, and the high concentration washing can be performed at a low water level in the early stage of washing.

Further, when the water level in the drum is sufficiently increased through the added re-supply of water, the water pressure sprayed through the nozzle may be improved, and the washing effect may be enhanced by the physical impact due to the water pressure.

In addition, by changing the amount of water added according to the washing water level, the rotation speed of the pump motor, and the time difference between water supplies, efficient washing can be performed, and the entire washing process time can be reduced.

Hereinafter, the pump RPM increase spray algorithm according to the re-supply of water during the main washing process will be described with reference to FIGS. 15 and 16.

Washing process is started (S1), and the controller 91 rotates the washing motor 95, and senses the amount of the laundry positioned in the drum 32 (S2). The laundry amount may be determined based on the principle that the rotation inertia of the drum 32 varies depending on the amount of the laundry loaded into the drum 32. For example, in the process of accelerating the washing motor 95, the amount of the laundry may be obtained based on the time taken to reach a preset target speed, obtained based on the acceleration slope of the washing motor 95, obtained based on the deceleration slope, or obtained based on the counter electromotive force in braking power generation. However, it is not limited thereto, and various methods for obtaining the laundry amount have been known in the field of washing machine technology. Accordingly, it is obvious that those known technologies can be applied.

The controller 91 supplies the washing water into the drum 32 (S3). The water supply is performed by opening the water supply valve 94, and the water supply may be performed up to a set water level. At this time, the set water level may be set according to the laundry amount sensed in step S2. For example, the set water level may be set in proportion to the laundry amount. The set water level may be a value obtained by substituting the laundry amount into a preset table or an equation.

The controller 91 may set a certain initial rotation speed of the circulation pump motor 92 according to the range of the laundry amount to which the sensed laundry amount belongs (S4). For example, the laundry amount may be subdivided into first to ninth levels. When the sensed laundry amount is divided into a small amount and a large amount, the case where the sensed laundry amount ranges from the first level to the fourth level may be classified as a small amount, and the case where the sensed laundry amount ranges from the fifth level to the ninth level may be classified as a large amount. However, the present invention is not limited thereto, and the laundry amount range can be divided for each level.

The initial rotation speed may be determined by the laundry amount, and the initial rotation speed in the case of a large laundry amount may be set higher than that in the case of a small laundry amount. Particularly, in the case of a small laundry amount, since most of the laundry moves at the front portion of the drum 32, the water stream sprayed from the nozzle does not need to reach the rear surface of the drum 32.

On the other hand, when the laundry amount is large, since the laundry all packed together into the central portion of the drum 32, it is preferable that the water stream sprayed from the nozzle reaches higher than the center of the drum 32.

The washing water is circulated through the circulation pump motor 92. In this process, washing water is sprayed into the drum 32 through at least one nozzle 610*b*, 610*c*, 610*d*, and 610*e*. At this time, as the drum is also rotated by the washing motor 95, the laundry positioned in the drum is moved. Here, the drum is driven by the combination of the rotation direction and the rotation speed of the washing motor 95, and the various driving motions of the drum are determined by the variety of rotation direction and rotation speed. The movement of the laundry inside the drum varies depending on the type of the drum driving motion.

The laundry is raised by the lifter 32*a* provided on the inner circumferential surface of the drum 32 when the drum 32 rotates. Thus, the impact applied to the laundry may be differentiated by controlling the rotation speed and the rotation direction of the drum 32. That is, the mechanical force such as friction between laundry, friction between laundry and washing water, and dropping impact of laundry may be differentiated. In other words, the degree of knocking or rubbing the laundry for washing may be differentiated, and the degree of dispersion or overturning of the laundry may be differentiated In order to drive the washing motor 95, the controller 91 sends a driving signal to the washing motor. At this time, it is divided into an on-time section in which a current is applied to the washing motor 95 through the driving signal and an off-time section in which no current is applied to the washing motor. The on-time section and the off-time section through the driving signal are periodically repeated to drive the washing motor.

Here, the ratio of the time actually driven by the washing motor (i.e., the on-time) to the total time (i.e., the sum of the on-time and the off-time) of the driving signal applied to the washing motor is defined as a practical operating rate.

According to an embodiment of the present invention, the on-time and the off-time may be repeated on a regular cycle, and the off-time section is not necessarily limited thereto, but may be three to four seconds.

In the off-time section, the washing motor 95 is turned off, and the rotation of the drum is also stopped, so that the rotation of the water stream is also instantaneously stopped. The controller 91 checks whether the washing motor is turned off (S5) and, when the washing motor is turned off, senses the water level in the drum (S6). The water level in the drum may be sensed by a water level sensor (not shown). Since the water level sensor is a well-known configuration in the art of washing machine, a detailed description thereof will be omitted.

The rotation of the washing motor 95 is intermittently repeated so that the rotation of the drum may be controlled by turning on/off the washing motor. When the washing motor 95 is turned-on, the controller 91 may control the washing motor 95 to rotate at a constant speed.

The controller 91 determines whether the water level sensed by the water level sensor reaches a preset water level (S7). The set water level may be determined based on the laundry amount sensed in step S2, and preferably, the water level may be set higher as the laundry amount is larger.

If the water level sensed by the water level sensor is not reached the set water level in step S7, the re-supply of water is performed (S8). The controller 91, which determined that the set water level has not been reached, may control the water supply valve 94 to be opened to perform the re-supply of water. The washing water supplied through the water supply valve 94 may be sprayed through the direct water nozzle 42. The amount of washing water may be gradually increased through the re-supply of water. A preset water amount may be re-supplied every time, and the preset water amount may not be limited to a specific value but may be a value adjusted according to various conditions (e.g., laundry amount).

When the re-supply of water is performed, the rotation speed rpm of the circulation pump motor 92 is raised by the controller 91 that sensed the re-supply of water (S9). Not only the washing water amount is increased due to the re-supply of water, but also the rotation speed of the circulation pump motor 92 is increased, so that the circulating flow rate is increased and the intensity of the water stream or the spraying intensity sprayed through at least one of the nozzles 610*b*, 610*c*, 610*d*, and 610*e* is also increased. Through the above-described process, since the strong spraying process is performed with a larger amount of water while progressing toward later stage of the washing, the mechanical force for the laundry may be increased stepwise.

In addition, the timing and the number of times of the re-supply of water and the increase of the rotation speed of the circulation pump motor 92 are not performed at a specific point of time and a specific number of times, but the timing and the number of times of the re-supply of water are automatically determined through determination of the water level, and thus, the increase of the rotation speed of the pump motor may be performed flexibly depending on the re-supply of water.

When the water level in the drum does not satisfy the set water level, the re-supply of water may occur several times. Therefore, after the re-supply of water occurs once and thus the pump rotation speed (rpm) of the circulation pump motor 92 is increased, if it is determined again that the water level in the drum is not reached the set water level during the off-time section, the re-supply of water may be performed again, thereby increasing the rotation speed (rpm) of the pump motor. The above process may be repeated several times.

A rotation speed increase range of the circulation pump motor 92 at the time of re-supply of water may be set according to the amount of the laundry sensed in the laundry amount sensing step S2. The rotation speed increase range may be set to be larger as the laundry amount sensed in the step S2 is larger.

Meanwhile, when the water level in the drum reaches the set water level, the re-supply of water is not performed any more, and the rpm increase of the circulation pump motor 92 due to the re-supply of water is not performed. For example, after the water level in the drum reaches the set water level, the washing process may be performed without any further re-supply of water. Accordingly, the rotation speed (rpm) of the circulation pump motor 92 is also maintained at a constant speed.

Meanwhile, even after the water level in the drum reaches the set water level, when the water level is lowered again below the set water level as the laundry absorbs the washing water, if it is determined that the lowered water level differs from the set water level by more than a preset value, water supply may be further performed.

Meanwhile, when it progresses to the later stage of the washing process after completing the above described re-supply of water, the circulation pump motor 92 rotates at a maximum rotation speed (S11). The maximum rotation speed of the circulation pump motor 92 is not the speed at which the circulation pump motor 92 can rotate maximally, but may be defined as a preset value as an upper limit of the rotation speed of the circulation pump motor 92. The maximum rotation speed value may be defined as a preset value as an upper limit of the rotation speed. The set value may be set in such a manner that the maximum rotation speed of the circulation pump motor 92 may be set depending on the laundry amount sensed in the laundry amount sensing step, and the set value of the maximum rotation speed may be higher when the sensed laundry amount is large.

The controller 91 may control the circulation pump motor 92 to maintain the maximum rotation speed, after the circulation pump motor 92 reaches the maximum rotation speed, despite the change of the water level in the drum 32.

In the case where the water level in the drum has not reached the set water level, during the re-supply of water (S8), the rotation speed rpm of the circulation pump motor 92 through the re-supply of water is increased (S9), but the increase value cannot exceed the maximum rotation speed.

This is because the present invention has an algorithm for changing the high-concentration washing process in the early and mid stages of the washing to a mechanical power washing process through the re-supply of water and the increase of the pump rpm while progressing toward the later stage of the washing, and thus has to maximize the washing effect by performing the washing process through the strong spray of washing water in the later stage of the washing.

When the re-supply of water is performed several times, the rotation speed of the circulation pump motor 92 may increase stepwise by the number of times of the re-supply of water to approach the maximum rotation speed.

In addition, regardless of the number of times of the re-supply of water, the pump motor may be rotated at a preset maximum rotation speed in the later stage of washing. This is because in some cases, it is not necessary to perform the re-supply of water, and sometimes the re-supply of water is required several times, and thus it is necessary to be able to perform the strong spay washing while the rotation speed of the pump motor in the later stage of the washing is maintained at the maximum rotation speed irrespective of the re-supply of water.

The rotation of the circulation pump motor 92 due to the re-supply of water is intermittently repeated. Therefore, the circulation of the washing water due to the re-supply of water may occur periodically.

When the rotation speed of the circulation pump motor 92 increases according to the re-supply of water, the increased rotation speed is maintained in a certain re-supply of water section before the next re-supply of water occurs. Therefore, when the re-supply of water is performed several times, a corresponding rotation speed of the circulation pump motor 92 may be increased stepwise.

When the above described washing process is performed and the washing is completed (S12), the pump motor may also be stopped (S13).

Although the exemplary embodiments of the present invention have been disclosed for illustrative purposes, those skilled in the art will appreciate that various modifications, additions and substitutions are possible, without departing from the scope and spirit of the invention as disclosed in the accompanying claims. Accordingly, the scope of the present invention is not construed as being limited to the described embodiments but is defined by the appended claims as well as equivalents thereto.

What is claimed is:

1. A method of controlling a washing machine that includes a drum configured to receive laundry therein, at least one nozzle configured to spray wash water to the drum, a pump motor configured to supply wash water to the at least one nozzle, the method comprising:

sensing a laundry amount received in the drum;

supplying water to the drum based on the sensed laundry amount;

rotating the pump motor at a first rotation speed to transfer washing water discharged from the drum to the at least one nozzle;

sensing a water level in the drum;

performing a re-supply of water to the drum based on the sensed water level being less than a set water level; and rotating the pump motor at a second rotation speed faster than the first rotation speed based on performing the re-supply of water.

2. The method of claim 1, further comprising:

by increasing a rotation speed of the pump motor, spraying water stream through the at least one nozzle in a range from a front surface of the drum toward a rear surface of the drum.

3. The method of claim 1, further comprising:

rotating the pump motor at a set maximum rotation speed based on the sensed water level being greater than or equal to the set water level.

4. The method of claim 3, further comprising:

increasing the set maximum rotation speed based on the sensed laundry amount being increased.

5. The method of claim 1, wherein rotating the pump motor at the second rotation speed comprises increasing the second rotation speed of the pump motor based on the sensed laundry amount being increased.

6. The method of claim 1, wherein rotating the pump motor at the first rotation speed comprises increasing the first rotation speed of the pump motor based on the sensed laundry amount being increased.

7. The method of claim 1, further comprising:

increasing the set water level based on the sensed laundry amount being increased.

8. The method of claim 1, wherein the washing machine further comprises a washing motor configured to rotate the drum, and wherein sensing the water level in the drum comprises sensing the water level in the drum in a state in which the washing motor is turned off.

9. The method of claim 1, further comprising:

additionally supplying water to the drum based on the water level in the drum being lowered below a threshold water level from the set water level after performing the re-supply of water.

10. The method of claim 1, wherein rotating the pump motor at the second rotation speed comprises rotating the pump motor repeatedly or intermittently.

11. The method of claim 1, further comprising:

maintaining the second rotation speed of the pump motor while performing the re-supply of water.

12. The method of claim 1, further comprising:

by increasing a rotation speed of the pump motor, spraying water stream through the at least one nozzle in a range from a side surface portion of the drum to a rear surface portion of the drum.

13. The method of claim 1, wherein performing the re-supply of water comprises spraying, through a direct water nozzle, water supplied through a water supply valve into the drum.

14. The method of claim 1, wherein the washing machine further comprises:

a casing;

a tub that is disposed in the casing and that defines a tub opening at a front surface of the tub;

a pump comprising the pump motor;

a gasket that has an annular shape and that connects between the casing and the tub opening; and a nozzle water pipe fixed to the gasket and configured to guide wash water pumped by the pump to the nozzle.

15. The method of claim 14, wherein the nozzle water pipe comprises:

a circulation pipe connection port connected to the pump and configured to receive wash water from the pump; and a transfer conduit connected to the circulation pipe connection port and configured to guide wash water from the circulation pipe connection port to the nozzle.

16. The method of claim 15, wherein the transfer conduit has an annular shape and surrounds a lower part of a circumference of the gasket, wherein the transfer conduit comprises:

a lower end connected to the circulation pipe connection port;

a first conduit part that extends from the lower end to a first side of the circumference of the gasket; and a second conduit part that extends from the lower end to a second side of the circumference of the gasket, and wherein the transfer conduit is configured to branch and guide water pumped to the circulation pipe connection port to the first and second sides of the circumference of the gasket.

17. The method of claim 15, wherein the transfer conduit has an annular shape and surrounds a lower part of a circumference of the gasket, and wherein the nozzle comprises:

a pair of intermediate nozzles that are disposed vertically above a center of the gasket and that are configured to spray water stream to the drum in a downward direction; and a pair of lower nozzles that are disposed vertically below the center of the gasket and that are configured to spray water stream to the drum in an upward direction.

18. The method of claim 17, wherein the pair of intermediate nozzles comprise a first intermediate nozzle connected to a first side portion of the transfer conduit and a second intermediate nozzle connected a second side portion of the transfer conduit, wherein the pair of lower nozzles comprise a first lower nozzle connected to the first side portion of the transfer conduit and a second lower nozzle connected to the second side portion of the transfer conduit, and wherein the pair of intermediate nozzles and the pair of lower nozzles are configured to spray wash water introduced into the transfer conduit into the drum.

19. The method of claim 15, wherein the circulation pipe connection port is connected to a lower end of the transfer conduit, and wherein the transfer conduit is configured to branch and guide, in plurality of directions from the lower end of the transfer conduit, water pumped to the circulation pipe connection port.

20. The method of claim 14, wherein the washing machine further comprises:

a water supply valve connected to a water source; and a direct water nozzle configured to spray water supplied through the water supply valve, and wherein the method further comprises:

based on performing the re-supply of water, spraying water supplied through the water supply valve into the drum through the direct water nozzle.

* * * * *